US009738088B2

(12) United States Patent
Narumi et al.

(10) Patent No.: US 9,738,088 B2
(45) Date of Patent: Aug. 22, 2017

(54) RECORDING APPARATUS AND RECORDING METHOD

(71) Applicant: CANON KABUSHIKI KAISHA, Tokyo (JP)

(72) Inventors: Kazuki Narumi, Komae (JP); Hiroshi Kawafuji, Kawasaki (JP); Yasunori Fujimoto, Inagi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/162,910

(22) Filed: May 24, 2016

(65) Prior Publication Data

US 2016/0347051 A1 Dec. 1, 2016

(30) Foreign Application Priority Data

May 29, 2015 (JP) ..... 2015-110375

(51) Int. Cl.
*B41J 29/393* (2006.01)
*B41J 2/21* (2006.01)

(52) U.S. Cl.
CPC ..... *B41J 2/2114* (2013.01); *B41J 2/2132* (2013.01); *B41J 2/2142* (2013.01); *B41J 29/393* (2013.01); *B41J 2029/3935* (2013.01)

(58) Field of Classification Search
CPC .... B41J 2/04505; B41J 2/2114; B41J 2/2132; B41J 29/393; B41J 2029/3935
See application file for complete search history.

(56) References Cited

U.S. PATENT DOCUMENTS 6,371,609 B1 * 4/2002 Oikawa ..... B41J 2/04573 347/19
2004/0125162 A1 * 7/2004 Valero ..... B41J 2/04505 347/16
2012/0313992 A1 * 12/2012 Wada ..... B41J 2/2114 347/15
2013/0021398 A1 * 1/2013 Mizes ..... B41J 2/2135 347/14
2013/0033538 A1 * 2/2013 Suzuki ..... B41J 2/2146 347/19
2013/0100191 A1 * 4/2013 Miyamoto ..... B41J 2/2114 347/14

(Continued)

FOREIGN PATENT DOCUMENTS

JP 2008143044 A 6/2008

*Primary Examiner* — Julian Huffman
(74) *Attorney, Agent, or Firm* — Canon U.S.A., Inc. IP Division

(57) ABSTRACT

A pattern of a first ink is formed on a recording medium using a first nozzle, a difference between smoothness of a surface at an edge portion of the pattern of the first ink in a predetermined direction and smoothness of a peripheral area of the pattern of the first ink on the recording medium is increased by applying another imparting material different from the first ink on the pattern of the first ink and a first adjustment pattern is formed, a second adjustment pattern of a predetermined imparting material is formed on the recording medium using a second nozzle, and a detection unit detects information by measuring specular reflected light when areas respectively including the first and the second adjustment patterns are each irradiated with light.

15 Claims, 20 Drawing Sheets

(56) References Cited

U.S. PATENT DOCUMENTS

| | | | | |
|---|---|---|---|---|
| 2014/0139583 | A1* | 5/2014 | Kammerzell | B41J 2/2114 347/19 |
| 2014/0285558 | A1* | 9/2014 | Wada | B41M 5/00 347/14 |
| 2015/0077452 | A1* | 3/2015 | Ebisawa | B41J 2/2114 347/12 |
| 2015/0328881 | A1* | 11/2015 | Ebisawa | B41J 2/0451 347/9 |
| 2016/0075146 | A1* | 3/2016 | Akiyama | B41J 2/2135 347/15 |

* cited by examiner

FIG.14

| | IMAGE CLARITY | | | | GLOSSINESS | | | |
|---|---|---|---|---|---|---|---|---|
| HIGHLIGHT PORTION | (a) | MIDDLE+ | (d) | MIDDLE+ | (a) | LOW | (d) | MIDDLE |
| HALFTONE PORTION | (b) | MIDDLE+ | (e) | MIDDLE | (b) | HIGH+ | (e) | MIDDLE |
| SHADOW PORTION | (c) | MIDDLE | (f) | MIDDLE | (c) | HIGH | (f) | MIDDLE |

FIG.15A
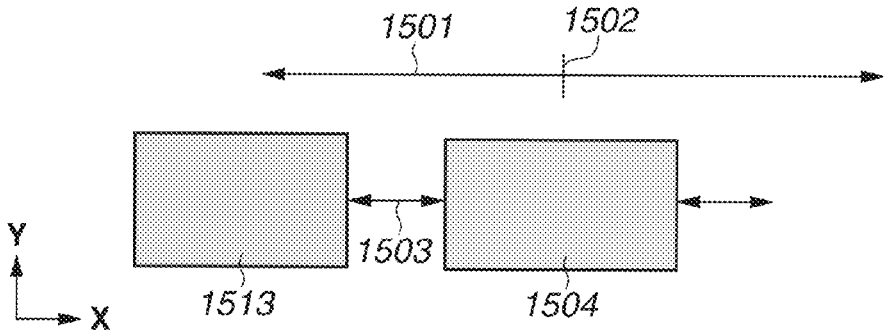
FIG.15B1
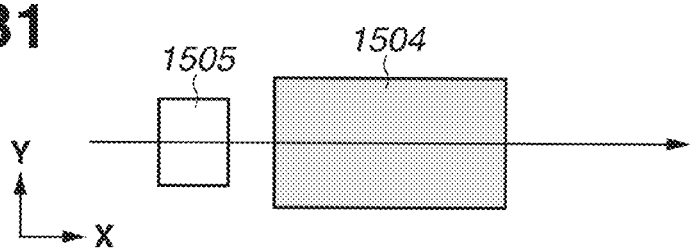
FIG.15B2
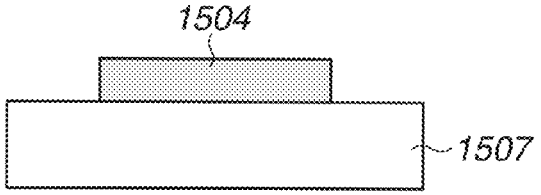
FIG.15B3
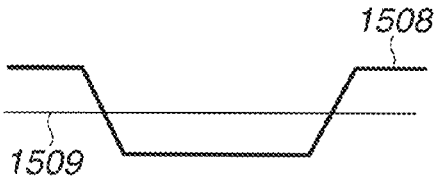
FIG.15B4
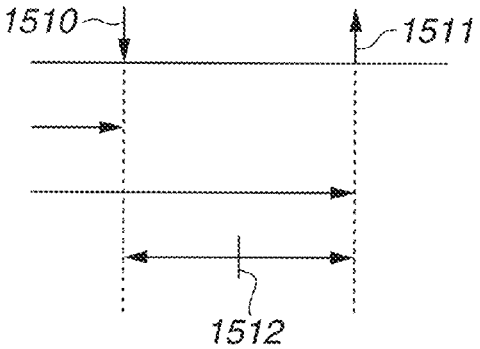

FIG.17A1
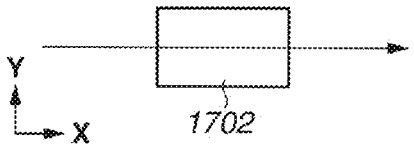
FIG.17B1
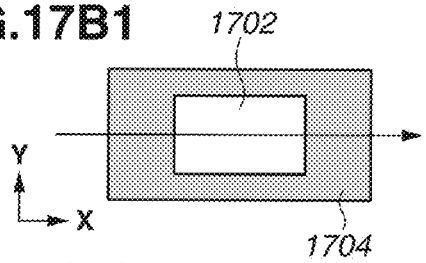
FIG.17A2
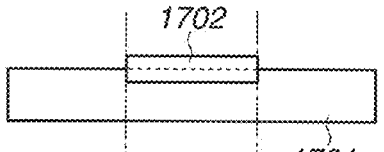
FIG.17B2
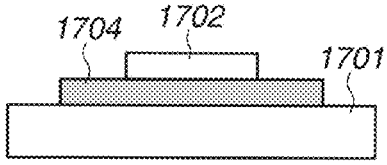
FIG.17A3
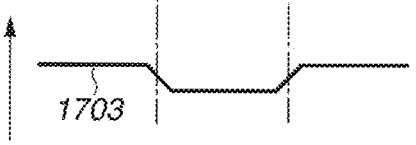
FIG.17B3
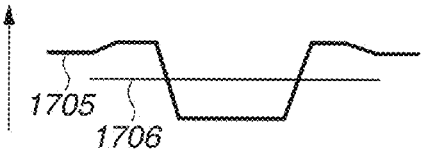
FIG.17C1
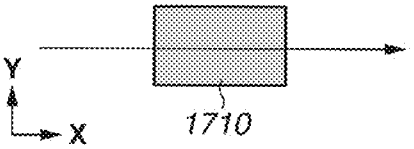
FIG.17D1
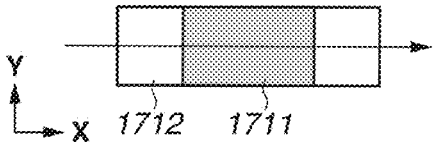
FIG.17C2
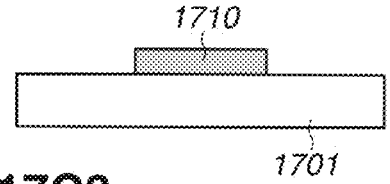
FIG.17D2
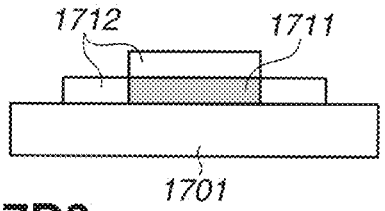
FIG.17C3
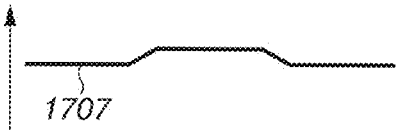
FIG.17D3
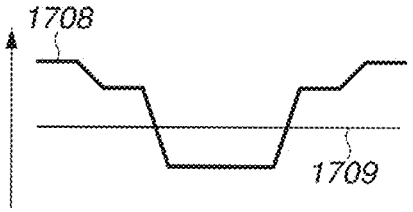

RECORDING APPARATUS AND RECORDING METHOD

BACKGROUND OF THE INVENTION

Field of the Invention

The present invention relates to a recording apparatus and a recording method.

Description of the Related Art

Ink jet recording apparatuses have advantages namely they can perform high density and high speed recording operations, and a recording method is low in running cost and quiet, and thus they have been commercialized as output apparatuses in various forms. In addition, recently, the ink jet recording apparatuses have been used for not only printing of office documents using plain paper but also printing of high image quality photographic images which is close to the image quality of silver halide photographs. It can be said that reduction in granularity of images by miniaturization of ink droplets, utilization of color materials in a plurality of densities, and so on is a major factor in an improvement of image quality of ink jet recording.

Recently, recording apparatuses are known which perform recording using imparting materials (particular color recording composition) of particular colors (for example, transparence, white, and the like) which do not change a hue of a recording medium when recorded on the recording medium (see, for example, Japanese Patent Application Laid-Open No. 2008-143044). Usage of the particular color which does not change the hue can realize an improvement in color development of a recorded image and an improvement in photograph image quality by imparting glossiness.

A discharge speed of an ink discharged from a nozzle varies depending on a property of each ink and characteristics of a recording element. Variation in the discharge speed of each ink leads to variation in an ink application position and deterioration of image quality. Further, if the discharge speed of each ink is constant without variation, a landing position of each ink color or each nozzle array may vary because of a distance between the nozzle arrays, inclination of the nozzle array, and the like. As a measure for correcting an application position, registration adjustment described below is generally performed which is important control for realizing high definition image recording. In addition, automatic registration adjustment is discussed which corrects the application position based on position information of a pattern read by an optical sensor. However, the above-described particular color imparting material which does not change a hue of a recording medium is difficult to be visually recognized when being imparted on the recording medium, and also it is difficult for the optical sensor to detect. Thus, implementation of the automatic registration adjustment is difficult and a countermeasure is required.

According to Japanese Patent Application Laid-Open No. 2008-143044, pattern recording using a color recording composition including a coloring material is performed in first, then pattern recording using the particular color recording composition is performed, and a relative position of a recording position of the particular color recording composition with respect to a recording position of the color recording composition is detected. Further, it is described that misalignment of the recording position can be easily detected by easily detecting a change in smoothness or a change in a reflected light amount caused by the change in the smoothness before and after the recording of the particular color recording composition, and a recording unit can be adjusted to eliminate the misalignment of the recording position when the recording position is deviated.

Adjustment items of the application position may include adjustment between forward and return paths and adjustment between colors. The adjustment between forward and return paths is to apply an ink of one color on a recording medium in a forward path and a return path and to perform adjustment based on the applied result. This adjustment uses only one color and can perform adjustment without depending on discharge characteristics of other colors. However, it is necessary for the adjustment between colors to detect patterns of each of a color to be a reference (a reference color) and another color of which an adjustment amount is required to be determined with respect to the reference color so as to recognize a relative relationship of the application positions of the two colors.

A landing position of a colored ink can be detected using a density sensor, and, for example, when the adjustment between colors is performed on colored inks, adjustment can be performed based on a detection result of the density sensor. However, it is difficult to detect a pattern of the above-described imparting material such as transparent or white one by the density sensor. In the case of the imparting material of which density is difficult to be detected, the adjustment of the application position can be performed by detecting a pattern in such a manner that specular reflected light of light irradiated on an area including the pattern is measured to detect a difference in the smoothness of the pattern and its peripheral area. It is assumed a case in which the adjustment of the application position is performed between a colored ink and an imparting material which is difficult to be detected by the density sensor as described in the adjustment between colors. In this case, it is not desirable that a pattern of the imparting material which is difficult to be detected by the density sensor is detected based on the smoothness, whereas a pattern of the colored ink is detected based on the density. For example, when a position of one pattern is detected by measuring its density by detection of diffused reflection light, and a position of the other pattern is detected by measuring its smoothness by detection of specular reflected light with respect to the light from a light source, there is a possibility that a detection error is caused due to misalignment of optical axes regarding detection of the diffused reflection light and the specular reflected light. As described above, regarding the imparting materials of different types, it is desirable to match detection methods for detecting respective patterns so as not to cause an error.

Therefore, when the imparting materials of different types are subjected to adjustment of a relative application position and an adjustment target includes the one which is not easy to be detected by the density sensor, it can be thought that a pattern of the adjustment target is detected by the smoothness of each pattern.

However, depending on a type of a colored ink, the smoothness of a pattern surface formed on a recording medium is high and is rarely different from the smoothness of a surface of a glossy recording medium, and it is revealed that it is difficult to detect the pattern with high detection sensitivity based on the difference in the smoothness in some cases.

SUMMARY OF THE INVENTION

The present invention is directed to a technique which suppresses a detection error when a pattern of a colored ink and a pattern of another imparting material are detected, suppresses reduction of detection sensitivity of each detected pattern, and accurately performs adjustment of a relative application position between both imparting materials in consideration of the above-described issue.

According to an aspect of the present invention, a recording apparatus includes a recording unit configured to perform recording on a recording medium using a first ink including a coloring material and a plurality of imparting materials including a first imparting material of which a type is different from the first ink and provided with a first nozzle for discharging the first ink and a second nozzle for discharging the first imparting material, a control unit configured to cause the recording unit to form a first detection patch and a second detection patch on the recording medium which are used for adjustment of a relative recording position between the first nozzle and the second nozzle on the recording medium; a detection unit configured to detect information indicating a relative position between the first detection patch and the second detection patch in a predetermined direction based on a measurement result of reflected light when areas respectively including the first and the second detection patches formed on the recording medium by the recording unit are irradiated with light, and a determination unit configured to determine a relative adjustment amount of an application position of the imparting material between the first nozzle and the second nozzle in the predetermined direction based on a detection result by the detection unit, wherein the control unit causes the recording unit to form the first detection patch of the first ink using the first nozzle on the recording medium, to increase a difference between smoothness of a surface of the first detection patch and smoothness of a peripheral area of the first detection patch on the recording medium by applying another imparting material different from the first ink on the formed first detection patch, and to form the second detection patch of the first imparting material on the recording medium using the second nozzle, and the detection unit detects the information by measuring specular reflected light when an area including the first detection patch to which the another imparting material is applied and an area including the second detection patch are each irradiated with light.

Further features of the present invention will become apparent from the following description of exemplary embodiments with reference to the attached drawings.

BRIEF DESCRIPTION OF THE DRAWINGS

FIG. 14 is a table of glossiness and image clarity of a recorded material according to the first exemplary embodiment.

FIGS. 15A and 15B1 to 15B4 are schematic diagrams illustrating how an adjustment pattern and a pattern are detected according to the first exemplary embodiment.

FIGS. 17A1 to 17A3, 17B1 to 17B3, 17C1 to 17C3, and 17D1 to 17D3 are schematic diagrams illustrating how an adjustment pattern and a pattern are detected according to the first exemplary embodiment.

DESCRIPTION OF THE EMBODIMENTS

A first exemplary embodiment according to the present invention is described below with reference to the attached drawings.

Figure 1:
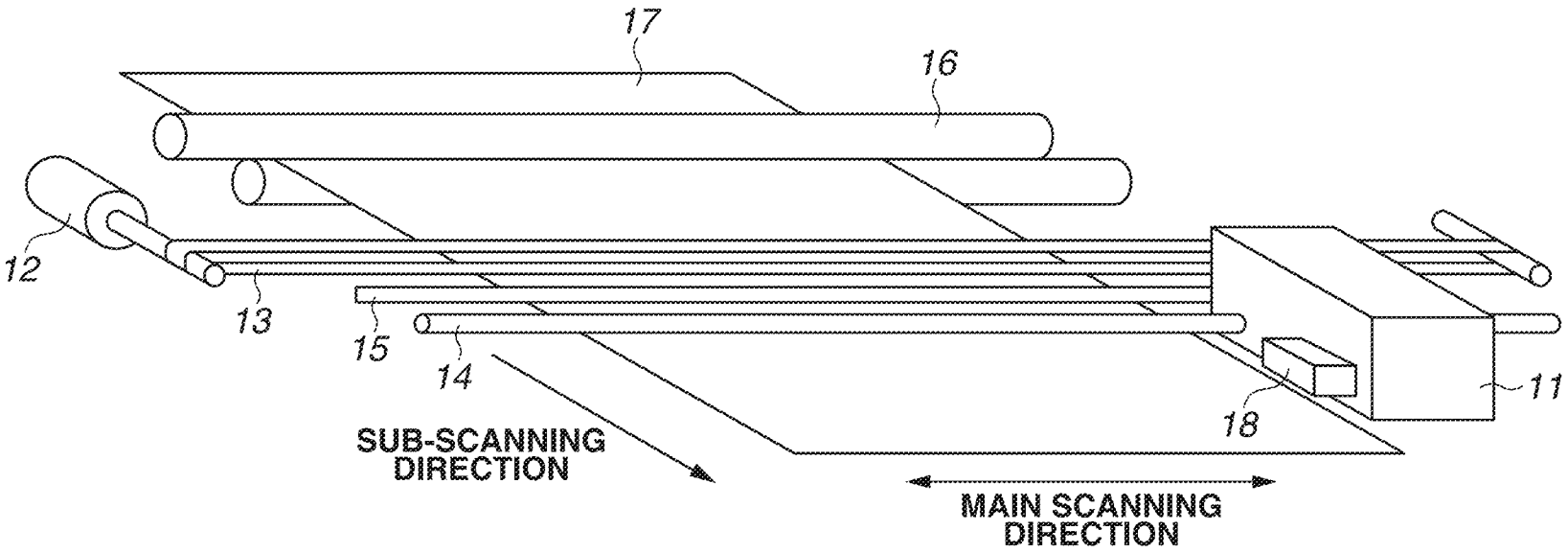
FIG. 1 is a perspective view of a recording apparatus according to a first exemplary embodiment.

FIG. 1 is a perspective view of an internal configuration of an ink jet recording apparatus according to the present exemplary embodiment. With a movement of a timing belt 13 which uses a carriage (CR) motor 12 as a driving source, a carriage 11 mounting a recording head reciprocates in a main scanning direction shown in FIG. 1 by being guided and supported by a guide shaft 14. A flexible cable 150 electrically connects a base plate of an apparatus main body and the recording head while following a movement of the carriage 11. A conveyance roller pair 16 pinches a recording medium 17 and conveys the recording medium 17 with the rotation of itself to a predetermined direction (a sub-scanning direction) intersecting the main scanning direction. Main scanning in which the carriage 11 moves in the main scanning direction while discharging an ink from the recording head according to recording data and a conveyance operation associated with the rotation of the conveyance roller pair 16 are alternately repeated, and thus an image is gradually formed on a recording medium. In addition, the carriage 11 is equipped with an optical sensor 18, and thus, when the carriage 11 performs scanning in the main scanning direction, reading can be performed in the main scanning direction.

Figure 2:
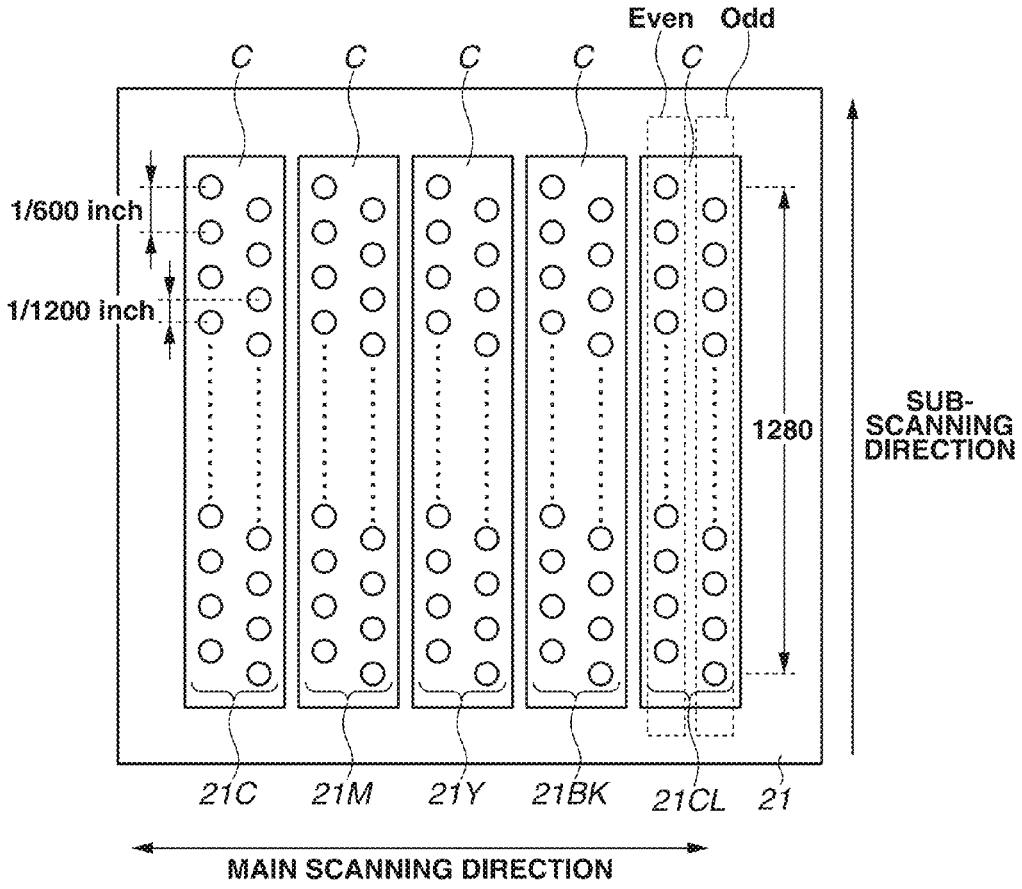
FIG. 2 is a schematic diagram illustrating a recording head according to the first exemplary embodiment.

FIG. 2 is a schematic diagram illustrating a nozzle opening side of a recording head 21 according to the present exemplary embodiment. The recording head 21 includes a nozzle array in which 1280 nozzles are aligned in the sub-scanning direction in a density of 1200 nozzles per inch for each ink color. A nozzle array 21C for discharging a cyan ink (C), a nozzle array 21M for discharging a magenta ink (M), a nozzle array 21Y for discharging an yellow ink (Y), and a nozzle array 21K for discharging a black ink (K) are aligned in the main scanning direction of the recording head 21. In addition, a nozzle array 21CL for discharging an ink which is colorless and transparent and used as an image quality improvement liquid (CL) is also aligned. In each of the nozzle arrays 21C, 21M, 21Y, 21K, and 21CL, two rows of the nozzle arrays are arranged in a staggered pattern by shifting 1/1200 inch from one another, and in one row of the nozzle array, nozzles are aligned in a density of 600 nozzles per inch. These two rows (hereinbelow, referred to as an Even array and an Odd array) are regarded as one nozzle array and used, and thus 1200 dots can be formed in each inch on the recording medium. These nozzle arrays are respectively disposed on different chips C, and each chip is adhesively fixed to a supporting member. However, a plurality of nozzle arrays or all of the nozzle arrays may be disposed on the same chip. An amount of an ink droplet (a discharge amount) discharged from each nozzle is approximately 4.5 pl. However, a discharge amount of the black ink may be set larger than other color inks so as to realize high density. The recording head according to the present exemplary embodiment discharges an ink using thermal energy and includes an electrothermal transducer within the nozzle for generating thermal energy. In this regard, the ink discharge method is not limited to the method using thermal energy and may be other methods such as a method for discharging an ink by a piezoelectric element.

The recording head 21 discharges the ink while scanning in the main scanning direction, so that dots can be formed in a recording density of 2400 dots/inch (dpi) in the main scanning direction and 1200 dpi in the sub-scanning direction. The recording head 21 for discharging the inks of five colors C, M, Y, K, and CL may be separately configured for each color or integrally configured. In addition to the above-described inks of five colors, a pale cyan ink and a pale magenta ink may be added in order to improve granularity, or a red ink, a green ink, and a blue ink may be added in order to improve color development.

(Ink Formulation)

An ink formulation according to the present exemplary embodiment is described in detail below. It is noted that the present invention is not limited to the following embodiments at all as long as it does not depart from the scope of the invention. In this regard, "part(s)" and "%" in the description are based on mass unless otherwise specifically noted.

<Preparation of Pigment Dispersion Liquid>

(Preparation of Black Pigment Dispersion Liquid)

First, a pigment 20.0 parts, a resin aqueous solution 60.0 parts, and water 20.0 parts were dispersed in a bead mill (LMZ2; manufactured by Ashizawa Finetech Ltd.) filled with zirconia beads having a diameter of 0.3 mm at a filling rate 80% at the number of rotations of 1,800 rpm for 5 hours. As the pigment, carbon black (trade name: Printex 90; manufactured by Degussa) was used. As the resin aqueous solution, an aqueous solution containing 20.0% of resin (solid content) was used which included Joncryl 678 (manufactured by Johnson Polymer), a styrene-acrylic acid copolymer, neutralized with potassium hydroxide of which an acid value was equivalent thereto. Then, aggregated components were removed by centrifugation at the number of rotations of 5,000 rpm for 30 minutes, further the solution was diluted with ion-exchanged water, and thus the black pigment dispersion liquid containing 15.0% of pigment and 9.0% of water-soluble resin (a dispersant) was obtained.

(Preparation of Magenta Pigment Dispersion Liquid)

A pigment of the dispersion liquid was changed to C.I. Pigment Red 122 (trade name: Toner Magenta E02; manufactured by Clariant). Other than that, the procedure similar to the above-described preparation of the black pigment dispersion liquid was used, and the magenta pigment dispersion liquid containing 15.0% of pigment and 9.0% of water-soluble resin (a dispersant) was obtained.

(Preparation of Cyan Pigment Dispersion Liquid)

A pigment of the dispersion liquid was changed to C.I. Pigment Blue 15:3 (trade name: Toner Cyan BG; manufactured by Clariant). Other than that, the procedure similar to the above-described preparation of the black pigment dispersion liquid was used, and the cyan pigment dispersion liquid containing 15.0% of pigment and 9.0% of water-soluble resin (a dispersant) was obtained.

(Preparation of Yellow Pigment Dispersion Liquid)

A pigment of the dispersion liquid was changed to C.I. Pigment Yellow 74 (trade name: Hansa Brilliant Yellow 5GX; manufactured by Clariant). Other than that, the procedure similar to the above-described preparation of the black pigment dispersion liquid was used, and the yellow pigment dispersion liquid containing 15.0% of pigment and 9.0% of water-soluble resin (a dispersant) was obtained.

<Preparation of Ink>

Each component (unit: %) in an upper stage of Table 1 was mixed, then filtered under pressure through a membrane filter of 1.2 μm in pore size (HDCII filter; manufactured by Pall Corporation), so that the pigment inks 1 to 6 were each prepared. A used amount of ion-exchanged water was equivalent to content which made a total amount of components 100.0%. Acetylenol E100 is a surface active agent manufactured by Kawaken Fine Chemicals Co., Ltd. In a lower stage of Table 1, content (unit: %) of the pigment in the pigment ink is shown. The ink obtained as described above was filled in each cartridge.

TABLE 1

Composition and characteristics of Ink

| Ink name | K | C | M | Y |
|---|---|---|---|---|
| Black pigment dispersion liquid | 30 | | | |
| Cyan pigment dispersion liquid | | 30 | | |
| Magenta pigment dispersion liquid | | | 30 | |
| Yellow pigment dispersion liquid | | | | 30 |
| glycerin | 10 | 10 | 10 | 10 |
| ethylene glycol | 10 | 10 | 10 | 10 |
| Acetylenol E100 | 1 | 1 | 1 | 1 |
| ion-exchanged water | 49 | 49 | 49 | 49 |
| Density of pigment | 4.5 | 4.5 | 4.5 | 4.5 |

Preparation of Image Quality Improvement Liquid

<Preparation of Resin Aqueous Solution>

As the resin aqueous solution, the aqueous solution containing 20.0% of resin (solid content) was used which included Joncryl 678 (manufactured by Johnson Polymer), a styrene-acrylic acid copolymer, neutralized with potassium hydroxide of which an acid value was equivalent thereto.

<Preparation of Ink>

Each component (unit: %) in Table 2 was mixed, then filtered under pressure through a membrane filter of 1.2 μm in pore size (HDCII filter; manufactured by Pall Corporation), so that a clear ink CL including resin was prepared. A used amount of ion-exchanged water was equivalent to content which made a total amount of components 100.0%. Acetylenol E100 is a surface active agent manufactured by Kawaken Fine Chemicals Co., Ltd. The image quality improvement liquid obtained as described above was filled in a cartridge.

TABLE 2

| Composition of Ink | |
|---|---|
| Ink name | CL |
| Resin aqueous solution | 20 |
| glycerin | 10 |
| ethylene glycol | 10 |
| Acetylenol E100 | 1 |
| Ion-exchanged water | 59 |

An effect of decreasing glossiness of a recorded material surface by recording the image quality improvement liquid which is the feature of the present exemplary embodiment on a colored ink than that of only the colored ink varies according to a refractive index of the resin. As described below, as the refractive index is smaller, the glossiness of the surface is decreased. The image quality improvement liquid may slightly take on some color tone according to a containing material and may contain some coloring materials for preparation. However, the image quality improvement liquid is substantially colorless and transparent compared to other colored inks.

(Optical Sensor)

Figure 3A:
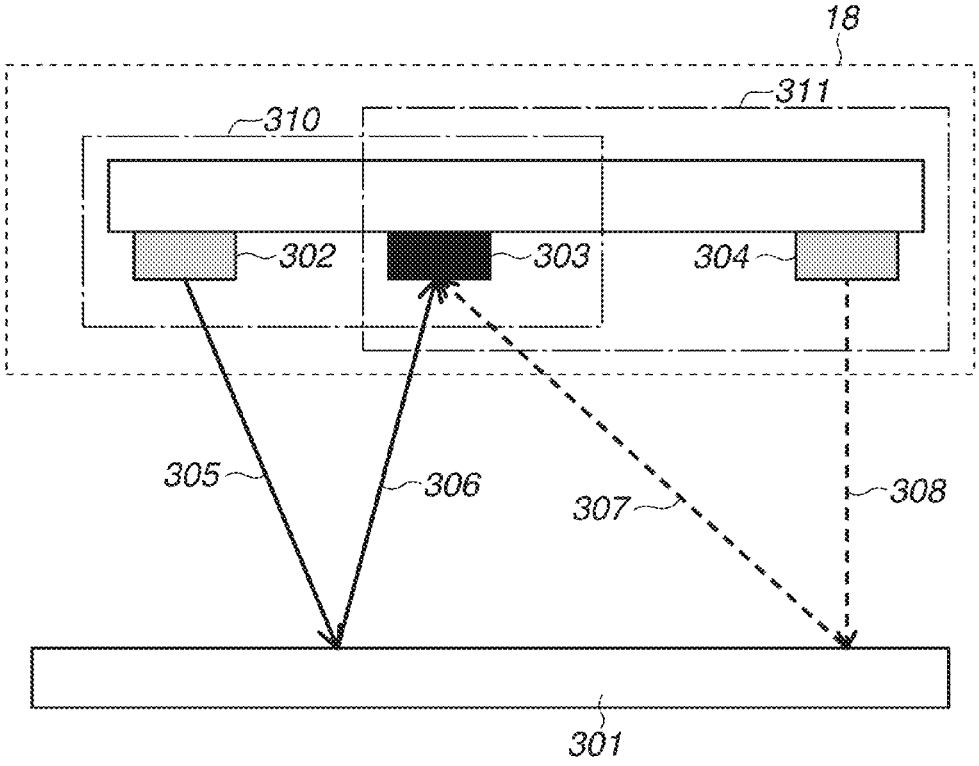
FIGS. 3A and 3B are schematic diagrams illustrating an optical sensor according to the first exemplary embodiment.
Figure 3B:
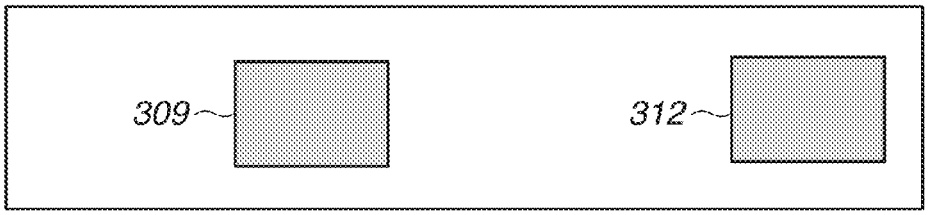

FIGS. 3A and 3B illustrate a configuration of the optical sensor 18 mounted on the recording apparatus in FIG. 1. The optical sensor 18 is arranged in such a manner that a measurement area is placed on a downstream side of a recording surface of the recording head 21, and a lower surface of the optical sensor 18 is placed at a same or higher position than a lower surface of the recording head 21. FIG. 3A is a cross-sectional view of the optical sensor 18.

The optical sensor 18 is provided with two light-emitting units 302 and 304 realized by three visible light emitting diode (LED) of read (R), green (G), and blue (B) and a light-receiving unit 303 realized by a photodiode. The two light-emitting units 302 and 304 specify an angular relationship between irradiation light and reflected light from a positional relationship among the light-emitting units 302 and 304 and the light-receiving unit 303. When reflected light of light emitted from the light-emitting unit 302 is received, angles of the incident light and of the reflected light are the same, and specular reflected light on a sheet surface can be detected, so that the optical sensor 18 functions as a specular reflection sensor 310. A reflected light amount of the specular reflected light varies under the influence of an irregularity and the refractive index of the surface which are described below, and thus the specular reflection sensor 310 can be used to detect the glossiness. When reflected light of light emitted from the light-emitting unit 304 is received, the optical sensor 18 functions as an irregular reflection sensor (hereinbelow, referred to as a density sensor 311) for detecting the diffused reflection light on a sheet surface. When diffused reflection light which does not include specular reflected light is detected, a color density of a detection surface can be detected.

In recording density measurement of an adjustment pattern used for automatic registration adjustment, which is described below, conveyance of the recording medium 301 in the sub-scanning direction and movement of the carriage 11 mounted on the optical sensor 18 in the main scanning direction are alternately performed. Accordingly, the optical sensor 18 detects a density of the adjustment pattern recorded on the recording medium as optical reflectance. When a patch formed on a sheet surface is irradiated with light, a level of reflection intensity reflecting a density of the patch can be detected. The reflection intensity becomes stronger on a white sheet surface, and as the density of the patch is higher, the reflection intensity becomes lower.

According to the present exemplary embodiment, a straight line connecting a center point of an irradiation range of the irradiation light emitted from a light emitting element to a measurement surface and a center of the light emitting element is referred to as an optical axis of the light emitting element. The optical axis of the light emitting element is also a center of light flux of the irradiation light. A line connecting a center point of an area (range) in which a light receiving element can receive light on the measurement surface (the measurement target surface) and a center of the light receiving element is referred to as an optical axis of the light receiving element or a light receiving axis. The light receiving axis is also a center of light flux of the reflected light reflected on the measurement surface and received by the light receiving element.

FIG. 3B illustrates detection areas of the optical sensor 18. A detection spot 309 is configured so that an irradiation area of the irradiation light and a detection area on a light receiving side overlap with each other on a reflection surface and has a size of 3 mm by 3 mm. A detection spot 312 is configured so that the irradiation area of the irradiation light and the detection area on the light receiving side overlap with each other on the reflection surface and has a size of 3 mm by 3 mm.

(Configuration Example of Image Processing System)

Figure 4:
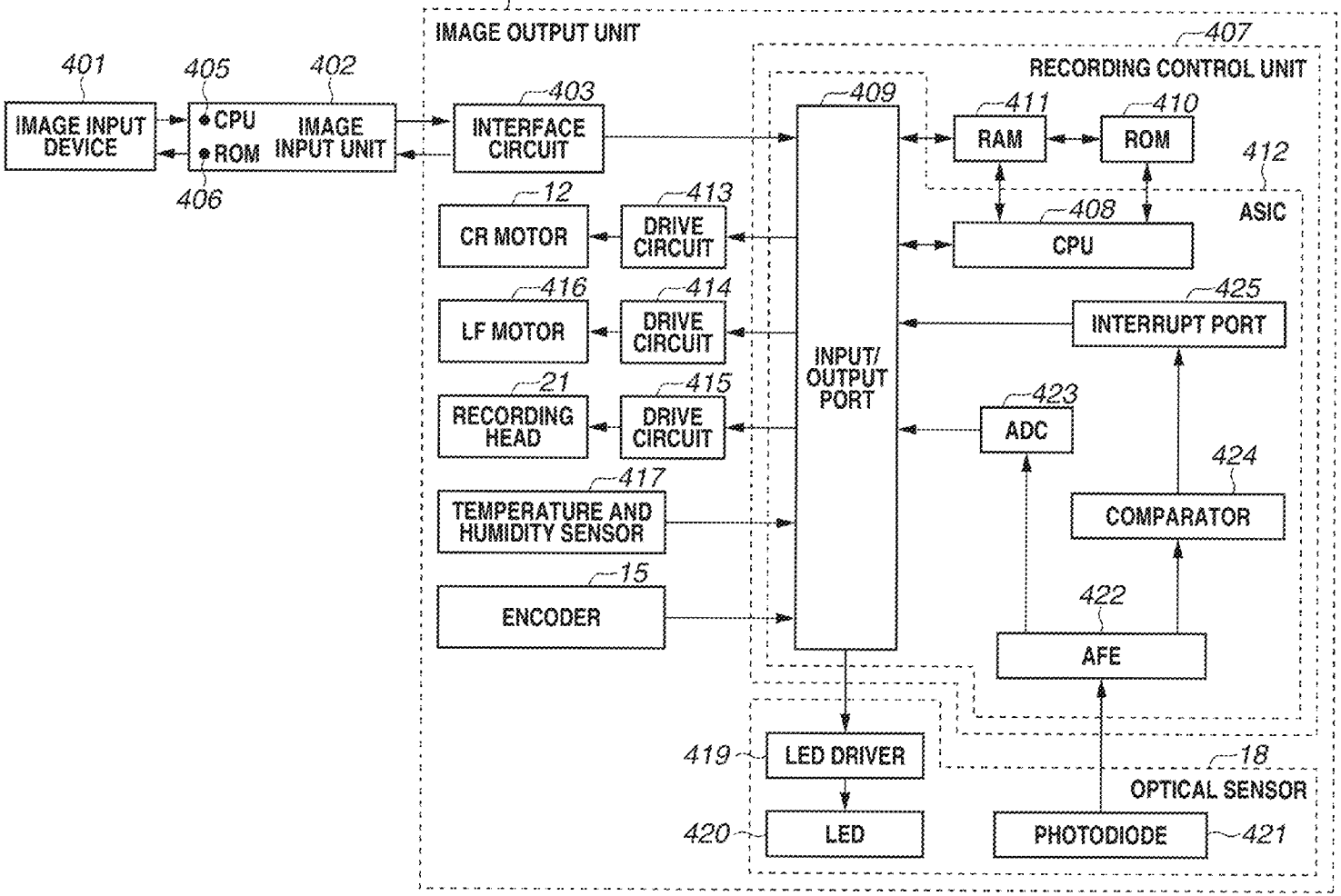
FIG. 4 is a block diagram illustrating a configuration for controlling the recording apparatus according to the first exemplary embodiment.

Next, a control configuration for executing recording control of the ink jet recording apparatus is described. FIG. 4 is a block diagram illustrating a configuration of a control system of the ink jet recording apparatus illustrated in FIG. 1. First, multivalued image data stored in an image input device 401 such as a scanner and a digital camera and various storage media such as a hard disk is input to an image input unit 402. The image input unit 402 is a host computer connected to the outside of the recording apparatus and transfers image information to be recorded to an image output unit 404, namely the recording apparatus via an interface circuit 403. The image input unit 402 is provided with a central processing unit (CPU) 405 necessary for transferring image data and a memory element (a read-only memory (ROM) 410). An embodiment of the host computer may be a computer as an information processing apparatus and may be in a form of an image reader.

A recording control unit 407 includes therein a CPU 408, an application specific integrated circuit (ASIC) 412 including an input/output port 409, the memory element (the ROM 410) storing a control program and others, and a random access memory (RAM) 411 functioning as a work area when various types of image processing is executed. The ROM 410 stores a control program of the CPU 408 and various data pieces such as a parameter necessary for a recording operation. The RAM 411 is used as a work area of the CPU 408 and also temporarily stores various data pieces such as image data received from the image input unit 402 and generated recording data. The ROM 410 further stores look-up tables (LUT) 502 and 504 as tables described below with reference to FIG. 5. The RAM 411 stores patch data for recording a patch. The look-up tables 502 and 504 may be stored in the RAM 411, and the patch data may be stored in the ROM 410.

The recording control unit 407 performs image processing described below on the multi-valued input image data transferred from the image input unit 402 to convert into binary image data. The recording control unit 407 further includes the input/output port 409 which is connected to the CR motor 12, a line feed (LF) motor 416 of a conveyance unit, and each of drive circuits 413, 414, and 415 of the recording head 21.

Based on the binary image data converted by the recording control unit 407, the ink is applied to the recording medium from each recording element of the recording head 21, and thus an image is formed.

Further, the input/output port 409 is connected to sensors such as the optical sensor 18 used for measurement of a color patch and detection of the recording medium and a temperature and humidity sensor 417 for detecting temperature and humidity of a circumference environment.

The ASIC 412 included in the recording control unit 407 controls an operation of the optical sensor 18. An LED 420 disposed in each of the light-emitting units 302 and 304 can selectively emit the three primary colors of red (R), green (G), and blue (B) light and is controlled by an LED driver 419 based on a patch color of a detection target and the like. A light-receiving signal from a photodiode 421 disposed in the light-receiving unit 303 is subjected to signal amplification processing, low-pass filter processing for removing noise, and other processing in an analog processing unit (analog front end: AFE) 422.

The analog signal processed in the analog processing unit 422 is input to the ASIC 412 as a digital signal via an analog-to-digital converter (ADC) 423. The analog signal is input to a comparator 424, and a comparator output is input as an interrupt signal to an interrupt port 425 of the ASIC 412. A signal from an encoder 15 for detecting a position of the carriage 11 is also input to the ASIC 412.

The ASIC 412 synchronizes an output signal from the optical sensor 18 with a position signal from the encoder 15 and processes the signal from the optical sensor as a density detection signal corresponding to the position of the carriage 11. Data of a read patch, a count value output from the encoder, and the like are stored in the RAM 411.

When performing below-described registration adjustment processing, the recording control unit 407 calculates a registration adjustment value (hereinbelow, referred to as an adjustment value in some cases) based on a measurement result of the adjustment pattern. The adjustment value is stored, for example, in the RAM 411 and the like. In addition, for example, the recording control unit 407 adjusts a discharge timing of the ink discharged from each nozzle based on the adjustment value stored in the RAM 411 and the like, and corrects a landing position (an application position) of a dot formed on the recording medium.

Figure 5:
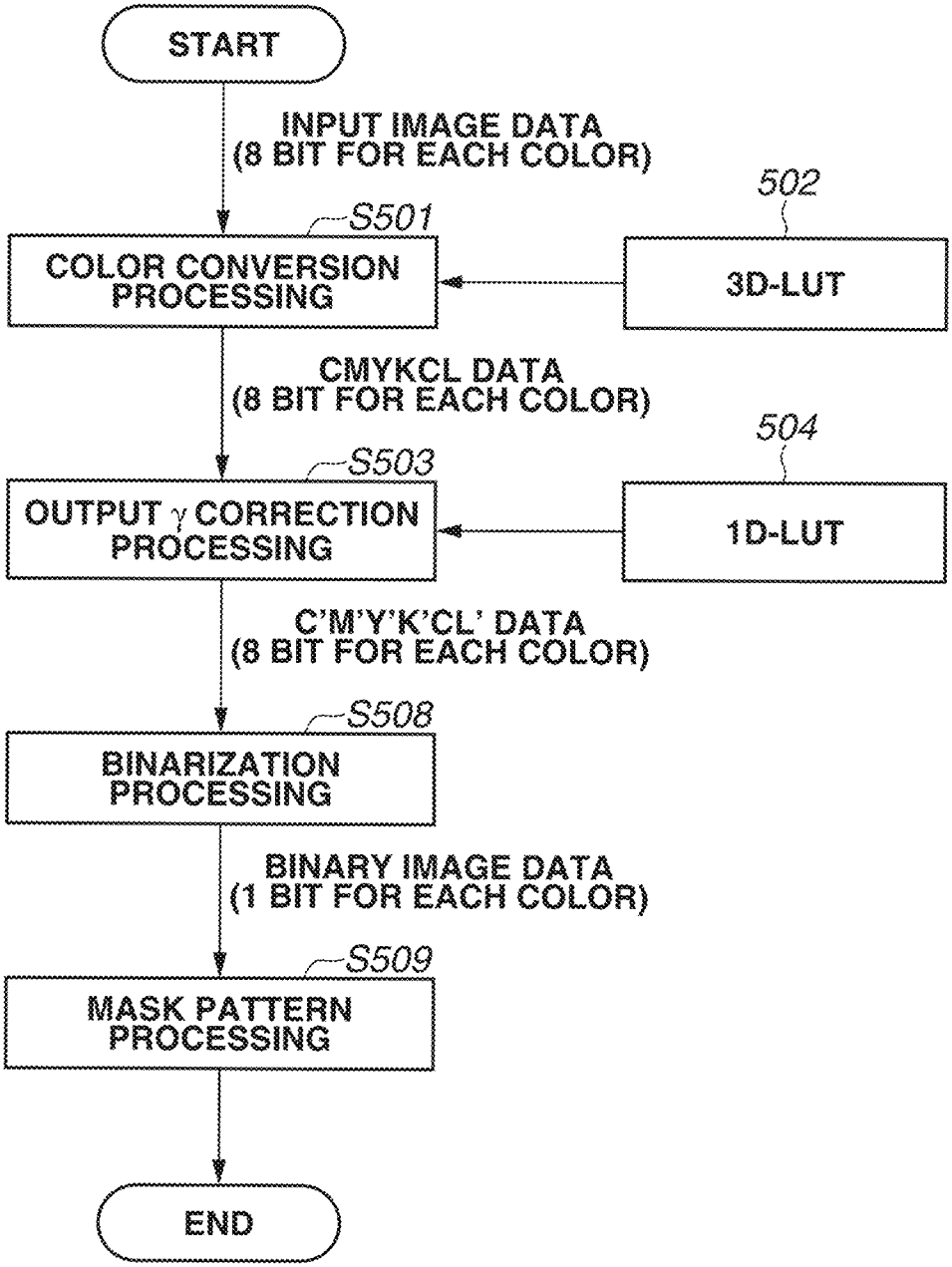
FIG. 5 illustrates a flow of image processing according to the first exemplary embodiment.

FIG. 5 is a flowchart illustrating processing performed in the recording control unit 407 illustrated in FIG. 4. The recording control unit 407 determines which nozzle is to be used for each pixel of image data. In step S501, color conversion processing is performed which converts input image data in which each color is composed of 8 bits into density signals of C, M, Y, K, and CL. More specifically, the input image data is converted at each pixel into multi-level gradation data (CMYKCL data) of a plurality of ink colors which can be printed by a printer by referring to a three-dimensional color conversion look-up table (3D-LUT) 502.

A dimension number of the 3D-LUT 502 indicates the number of components (elements) of the input image data input to the color conversion processing in step S501. However, only the density signal corresponding to a specific and discrete RGB signal is stored in the 3D-LUT 502 which does not correspond to all combinations of RGB signals expressed by 256 stages of each color. Therefore, the RGB signal in an area which is not stored in the 3D-LUT 502 is calculated by interpolation processing using a plurality of stored data pieces. A known interpolation processing method is used here, so that the detailed description thereof is omitted. A value of the multi-level gradation data (CMYKCL data) converted by the color conversion processing in step S501 is expressed by 8 bit similarly to the input image data as the input value and output as a density value having a 256-stage gradation value.

Hereinbelow, the CL is described which is colorless and transparent and used as the image quality improvement liquid for gloss controlling. In the present specification, "glossiness" and "image clarity" are used as references indicating a level of gloss visually sensed. First, an evaluation method of the glossiness and the image clarity is described.

Figure 6A:
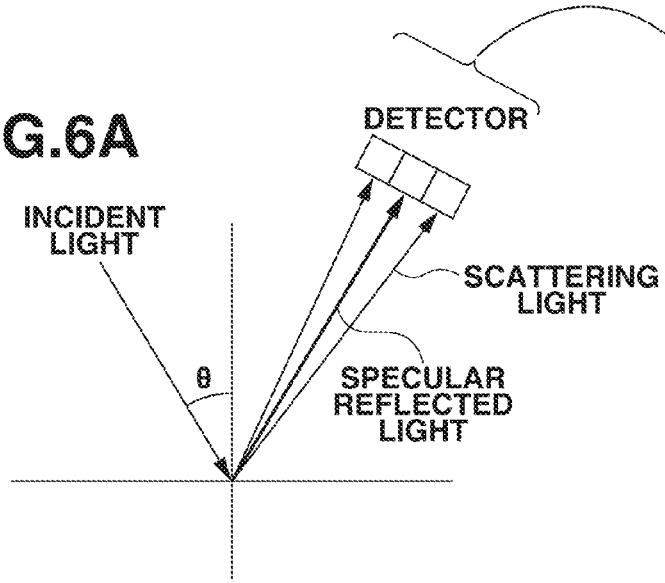
FIGS. 6A to 6D illustrate a measurement method of glossiness and image clarity.
Figure 6B:
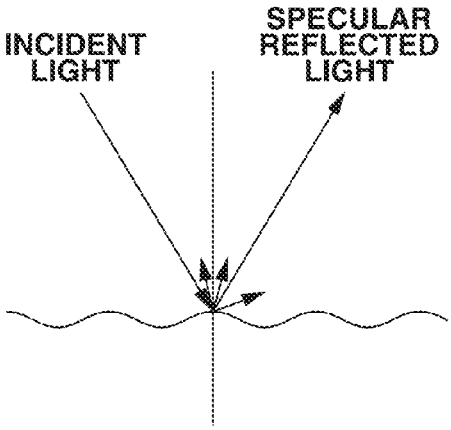
Figure 6C:
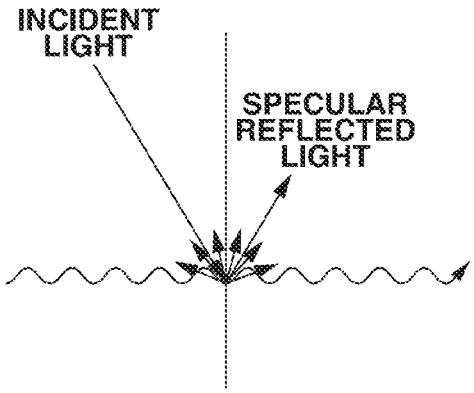
Figure 6D:
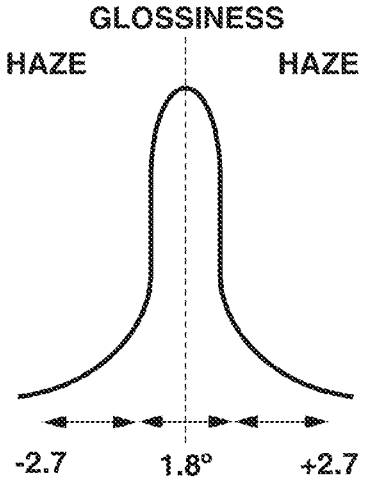
Figure 20:
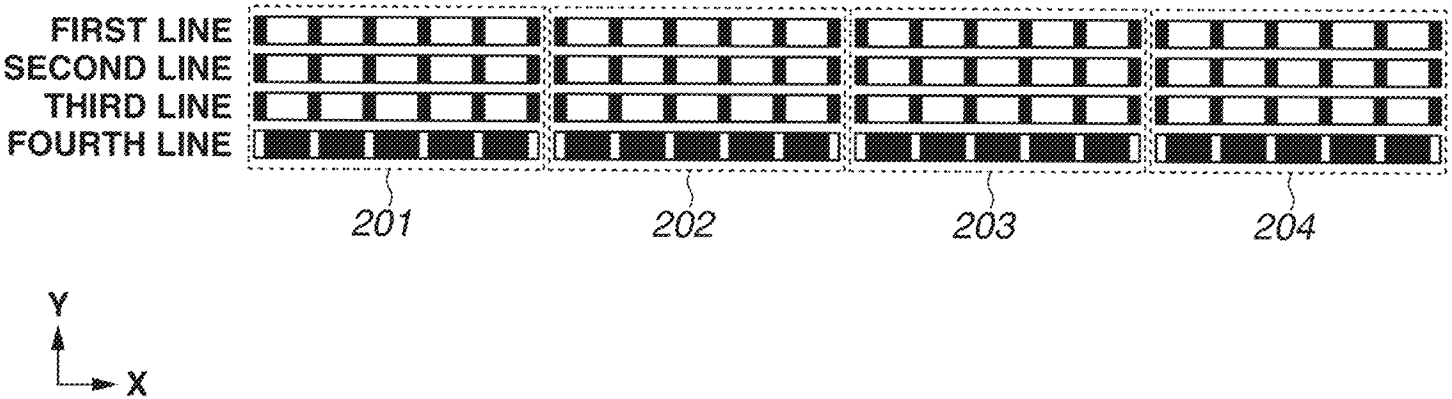
FIG. 20 is a schematic diagram of adjustment patterns according to a second exemplary embodiment.

FIG. 6A to 6D illustrate the measurement method of the glossiness and the image clarity. With reference to FIG. 6A, 20° specular glossiness (hereinbelow, described as the glossiness) is to detect reflected light of light incident on a surface of a printed material at an incident angle $\theta=20°$. For a detector, for example, B-4632 manufactured by BYK-Gardner (Japanese product name: Micro-Haze Plus) can be adopted. A detection unit detects light intensity in a range of an aperture width of 1.8° centered at an axis of the specular reflected light as illustrated in FIG. 6A, and accordingly, intensity distribution having a peak at a specular reflection angle can be obtained as illustrated in FIG. 6D. In this regard, intensity of the specular reflected light with respect to intensity of the incident light is the glossiness, of which a unit is non-dimensional. The glossiness and the measurement method described above conform to Japanese Industrial Standards (JIS) K 5600.

Image clarity represents sharpness of an image reflected in an object and is detected using, for example, JIS H 8686 "Anodizing of aluminum and its alloys-Visual determination of image clarity of anodic oxidation coatings". The Image Clarity Meter ICM-1T (manufactured by Suga Test Instruments Co., Ltd.) and the Image Clarity Measuring Device GP-1S (manufactured by Optec) are commercially available devices for measuring image clarity that conform to JIS standards. When an irregularity is small on a surface of a recording medium as the object, an amount of light diffused on the surface of the recording medium is small as illustrated in FIG. 6B, and thus the specular reflected light is strong compared to the diffusion light. In other words, light reflected on the surface tends to be parallel, so that a relatively sharp image is captured, and a value of the image clarity is high. On the other hand, when an irregularity is large on the surface of the recording medium as illustrated in FIG. 6C, the reflected light is diffused in various directions, and the specular reflected light is weak. In other words, the light reflected on the surface travels various courses, so that a blurred image is captured, and a value of the image clarity is low. As described above, the glossiness and the image clarity vary depending on surface roughness of a reflection surface.

Figure 7A:
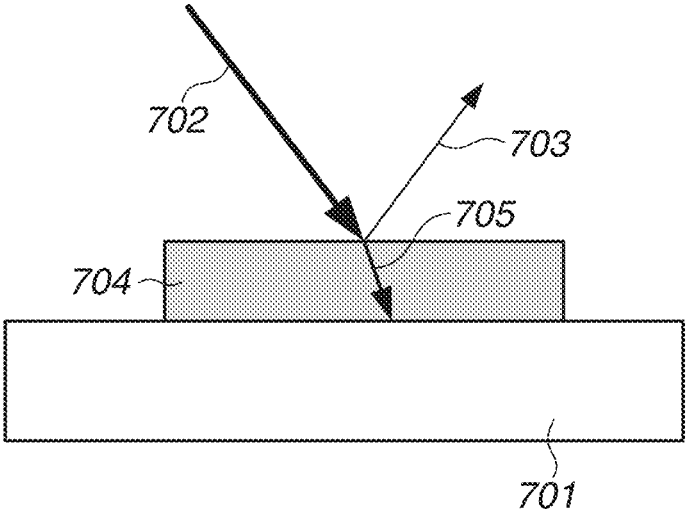
FIGS. 7A and 7B illustrate glossiness.
Figure 7B:
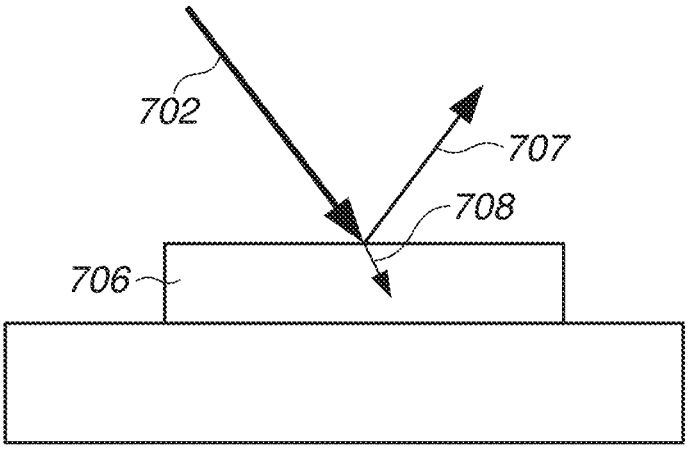

Further, it is known that the glossiness varies depending on not only the surface roughness of the recording medium but also a refractive index based on a material and a layer structure. FIGS. 7A and 7B illustrate change in the glossiness due to the refractive index. FIG. 7A illustrates a way of traveling (an optical path) of incident light 702 on a surface of an ink layer 704 which has a certain refractive index. The incident light 702 incident on a recording medium 701 is separated into reflected light 703 and transmitted light 705 refracted and entering the ink layer 704 at an interface between an air layer and the ink layer 704. A separation ratio of the reflected light 703 and the transmitted light 705 is determined based on the refractive index of the ink layer 704.

On the other hand, FIG. 7B illustrates incidence and reflection of the incident light 702 on a surface of an ink layer 706 of which a refractive index is relatively larger than that of the ink layer 704. Since the refractive index of the ink layer 706 is large, the incident light 702 cannot enter into the ink layer 706 much. Thus, light intensity of transmitted light 708 is lower than that of the transmitted light 705 transmitting through the ink layer 704 illustrated in FIG. 7A. In contrast, reflected light 707 is larger than the reflected light 703. In other words, as the refractive index of an area irradiated with the incident light is larger, the glossiness becomes larger. For example, as a refractive index of a resin which is a component included in the CL and mainly remaining on the ink layer is lower, the glossiness when an area in which the colored ink is recorded is overcoated by the CL is decreased.

For simplifying the description, it is described on the assumption that there is no irregularity on surfaces of the ink layers 704 and 706. In reality, the glossiness of the recorded material is determined from both of a degree of diffusion and the refractive index by the above-described irregularity of the surface.

Regarding a recorded material, it is not always true that higher glossiness and image clarity are more desirable, and there is a range appropriate for observation. According to the review by the inventors, a range of such glossiness was determined as 30 to 60 at 20° specular glossiness. Therefore, according to the present invention, recording control is performed so as to keep the glossiness of the recorded material within a range from 30 to 60 regardless of a recorded image. More specifically, the glossiness and the image clarity vary according to a type and a recording density (gradation) of an ink to be used, and thus a recording amount and a recording timing of the image quality improvement liquid are adjusted according an image so as to conform the glossiness of an entire image to the above-described range.

Figure 8A:
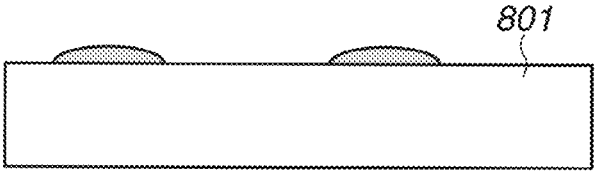
FIGS. 8A to 8F illustrate states in which a pigment ink and an image quality improvement liquid are recorded on a recording medium.
Figure 8B:
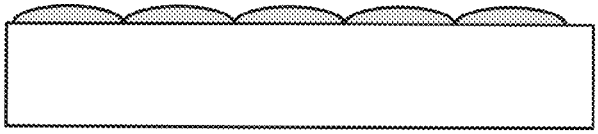
Figure 8C:
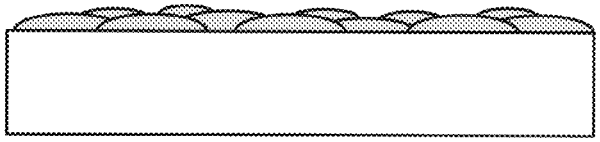
Figure 8D:
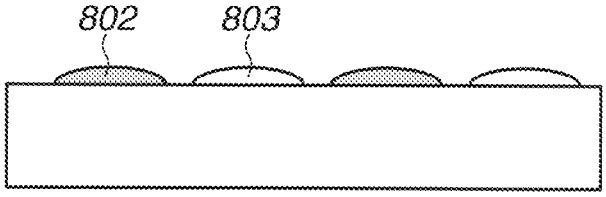

FIG. 8A to 8F illustrate states in which a color ink 802 and a clear ink 803 are recorded on a recording medium 801 for each density area. When a dot recording density is low in the case of a highlight portion, recorded dots are sparse as illustrated in FIG. 8A, and the gloss of the recording surface depends on the gloss of the recording medium itself. Generally, the glossiness of a blank page portion tends to be lower than that of an area in which the pigment ink is recorded. Thus, the glossiness of the highlight portion is lower and easily detected than the glossiness of the medium density area and the high density area in which more dots are recorded. Thus, according to the present exemplary embodiment, the image quality improvement liquid is recorded in places in an area in which the pigment ink is not recorded as illustrated in FIG. 8D in order to improve the glossiness of the highlight portion to the degree of 30 to 60.

Figure 8E:
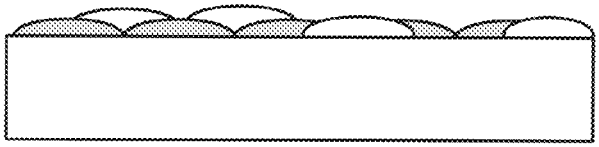

On the other hand, regarding a gradation in which more dots are recorded as the medium density area, the surface of the recording medium is mostly covered with the wide-spread pigment ink as illustrated in FIG. 8B. At that time, the recording surface is smooth, and the glossiness thereof exceeds 100 which is high compared to the desirable range 30 to 60. Thus, according to the present exemplary embodiment, an appropriate amount of the image quality improvement liquid is recorded so as to dare to disturb the smoothness of the recording surface. However, the recording medium has an upper limit of an absorbable liquid amount, and even if the image quality improvement liquid is recorded to the upper limit on a smooth layer already formed, the glossiness is too high to be sufficiently decreased. Thus, according to the present exemplary embodiment, the pigment ink and the image quality improvement liquid are mingled and recorded at almost the same timing, and thus an irregularity is formed on the recording surface as illustrated in FIG. 8E, and the glossiness too high can be suppressed.

When further more dots are recorded by overlapping with each other as the high density area, an amount of the solid content such as a coloring material and a dispersed resin in the pigment ink become larger, and irregularities are many formed in whole as illustrated in FIG. 8C. Especially, such irregularities are more remarkable when a plurality of different pigment inks overlap with each other. Thus, the glossiness of the high density area tends to be lower than that of the medium density area. However, according to the review by the inventors, the glossiness was within a range of 60 to 80 which exceeded the desirable range 30 to 60. Therefore, it is necessary to apply a certain amount of the image quality improvement liquid to the high density area to decrease the glossiness.

Figure 8F:
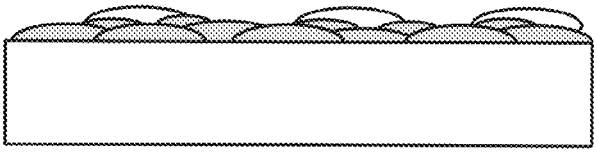

However, many irregularities are already formed on the high density area as illustrated in FIG. 8C, and if the image quality improvement liquid is applied by the same method as the medium density area, there is a concern that the image clarity is further decreased. Thus, according to the present exemplary embodiment, the image quality improvement liquid is overcoated on the area where the pigment ink is already recorded as illustrated in FIG. 8F. Accordingly, the glossiness can be suppressed in the desirable range.

As described above, according to the present exemplary embodiment, the image quality improvement liquid is applied in an amount appropriate for each density area at an appropriate timing. More specifically, four pieces of multi-valued data respectively corresponding to four types of colored inks C, M, Y, and K and also first multi-valued data CL1 and second multi-valued data CL2 corresponding to the image quality improvement liquid are generated based on the input image data. The first multi-valued data CL1 is multi-valued data for the image quality improvement liquid which is recorded at the almost same timing as the colored ink as described with reference to FIG. 8D. The second multi-valued data CL2 is multi-valued data for the image quality improvement liquid which is recorded after the colored ink is recorded as described with reference to FIG. 8F.

Figure 9:
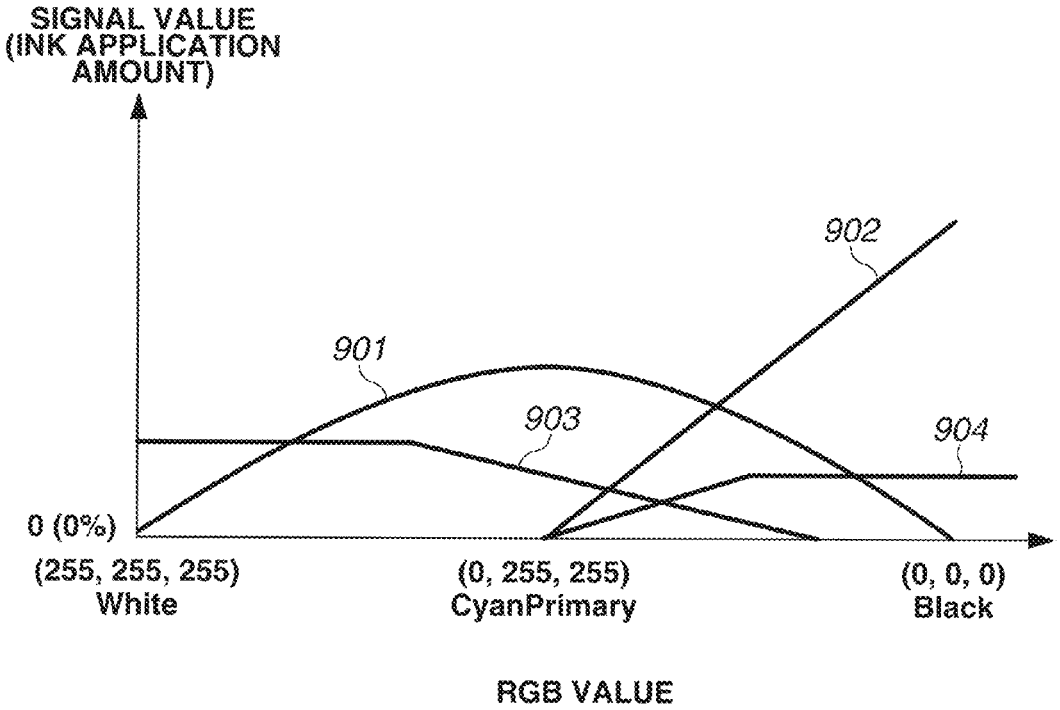
FIG. 9 illustrates color conversion processing according to the first exemplary embodiment.

FIG. 9 illustrates an example of signal value conversion executed in the color conversion processing in step S501 according to the present exemplary embodiment. A horizontal axis indicates input signal values of a cyan line from white of (R, G, B)=(255, 255, 255) via cyan of (R, G, B)=(0, 255, 255) to black of (R, G, B)=(0, 0, 0). A vertical axis indicates respective output signal values of C (cyan) 901, K (black) 902, CL1 (the first multi-valued data of the image quality improvement liquid) 903, and CL2 (the second multi-valued data of the image quality improvement liquid) 904 corresponding to the individual input signal values.

In the cyan line, the output signal C 901 for the cyan ink gradually increases from zero, reaches a peak at cyan (0, 255, 255), further gradually decreases toward black, and reaches zero at black. On the other hand, the output signal 902 of the black ink is zero until cyan (0, 255, 255), gradually increase thereafter, and reaches a maximum at black. As described above, a total sum and proportion of the respective output signal values including the C 901 and the K 902 vary in response to the input signal value. In addition, the output signal value correlates with an ink application amount per unit area, and thus the glossiness and the image clarity of the recording surface expressed by the colored ink also vary in response to the input signal value.

According to the present exemplary embodiment, the first multi-valued data CL1 of the image quality improvement liquid recorded at the same timing as the colored ink and the second multi-valued data CL2 of the image quality improvement liquid recorded after the recording of the colored ink are adjusted in response to the output value of the colored ink, and the glossiness and the image clarity are controlled as described with reference to FIGS. 8A to 8F. As illustrated in FIGS. 8A to 8F, according to the present exemplary embodiment, the CL1 (the first multi-valued data) is mainly used in cyan from highlight to the medium density of which the dot recording density is relatively low. Further, the CL1 is gradually decreased to zero in the end from cyan to black of which the dot recording density is relatively high, and the CL2 (the second multi-valued data) is gradually increased along with this decrease. In other words, the image quality improvement liquid is applied at the same timing as the cyan ink from highlight to cyan, and a recording state as illustrated in FIG. 8D or FIG. 8E is obtained. On the other hand, in the area near black, the image quality improvement liquid is applied after the recording of the cyan ink and the black ink, and the recording state as illustrated in FIG. 8F is obtained. In either case, the glossiness and the image clarity in the desirable range are obtained, and gloss unevenness can be suppressed.

Here, a timing (signal value) to start decreasing the CL1 (the first multi-valued data) is approximately the same as the timing when the K becomes larger than zero, however, the present exemplary embodiment is not limited to the above-described signal value conversion. When a sheet surface is brought into a state fully covered with the ink even in an area near highlight and in which the K is zero, the signal value of the CL1 may be decreased, and the CL2 may be set larger than zero according to the glossiness.

As described above, the cyan line is described as the example in FIG. 9, however, the adjustment like this can be optimized in all gradations of the all colored inks. In this case, the CL appropriate for the multi-valued data pieces (C, M, Y, K) converted from the individual input signal values (R, G, B) may be associated with data in the 3D-LUT 502 referred to in the color conversion processing in step S501. Data does not correspond to a grid point in the 3D-LUT 502 may be converted by combining interpolation calculation.

Next, in step S503, output γ correction processing is performed for correcting the CMYK+CL data pieces which have been subjected to the color conversion. The data is corrected for each ink color by referring to the 1D-LUT 504 which is a one-dimensional correction table so that an optical density finally expressed by the recording medium maintains linearity with respect to the input density signal. C'M'Y'K'CL' data pieces output here each has an 8-bit density value as with the input image data.

Next, in step S508, binarization processing is performed for converting the data to 1-bit binary image data which defines a recording position of a dot that the recording head 21 can record. To the binarization processing, general multi-level error diffusion processing can be adopted. In step S509, a mask pattern to be used in mask pattern processing described below is selected based on the binary image data, and the output image data is generated for each scanning.

Optimum conversion methods for the color conversion processing in step S501, the output γ correction processing in step S503, and the binarization processing in step S508 are different according to a type of a recording medium, a type of an image to be recorded, and the like. Especially, the 3D-LUT 502 used in the color conversion processing is prepared for each type of a recording medium.

The mask pattern processing in step S509 is specifically described with reference to FIG. 10. The mask pattern is stored in the ROM 410 in the recording control unit 407. In the mask pattern processing in step S509, the image data of each color is divided for each record scanning using the mask pattern, and dot data is generated for each record scanning and each ink color.

Image data 101 represents a recording density of a unit pixel in a recorded image which is 50% here. The binarization processing is performed on an image pixel having the recording density 50%, and 4 by 2 recorded pixels obtained by simultaneously performed resolution conversion are indicated in binary image data 102. In the binary image data 102, there are four black pixels indicating recording of dots and four white pixels indicating non-recording of dots, and the recording density is 50%. According to the present exemplary embodiment, the recording density indicates proportion of pixels in which dots are actually recorded to pixels on the recording medium arranged in 1200 dpi by 1200 dpi. In other words, the recording density of 50% means that dots are recorded in a half of all pixels.

Figure 10:
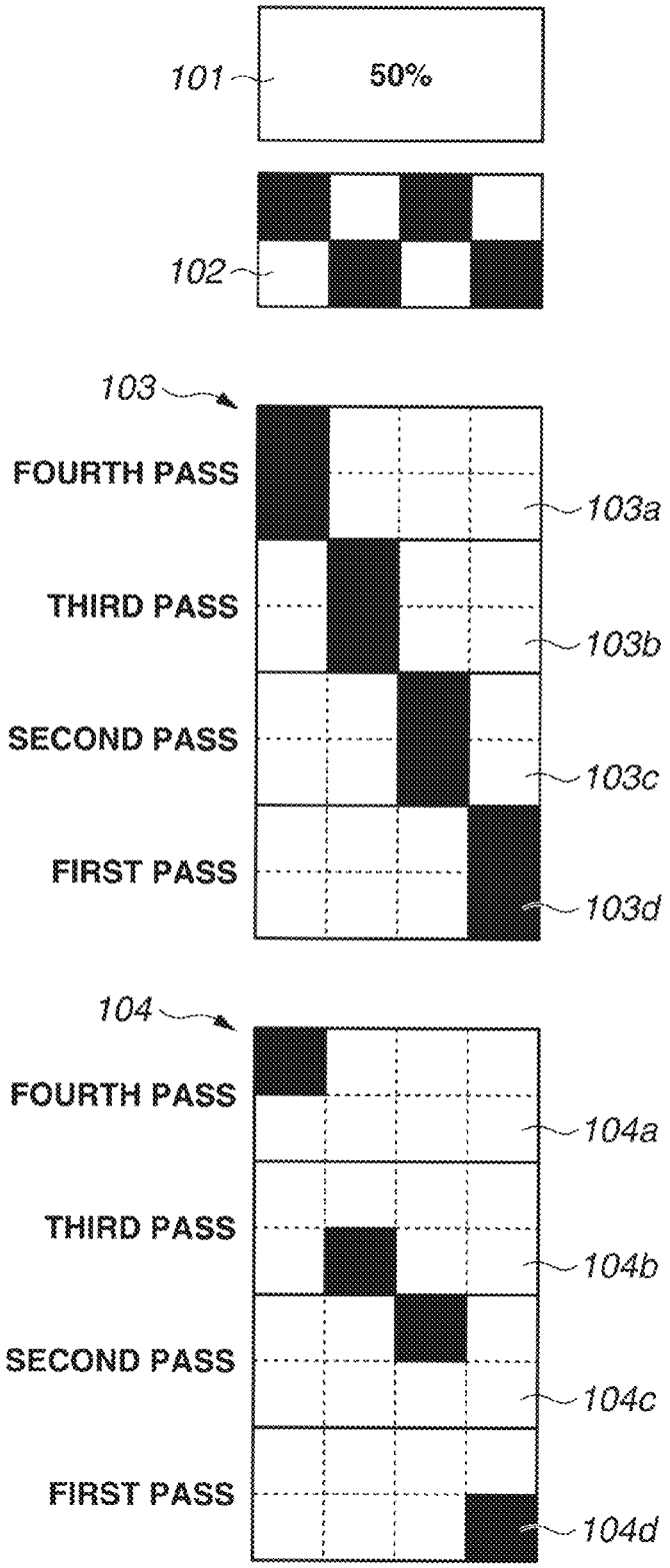
FIG. 10 illustrates a multipass recording method according to the first exemplary embodiment.

In FIG. 10, an example of a mask pattern 103 is to be used in the multipass recording for four passes in which an image is recorded by four times of record scanning. A mask pattern is constituted of a plurality of pixel areas indicating permission or non-permission of recording of dots. Black areas represent recording permissible pixels in which recording of dots is permitted, and white areas represents recording non permissible pixels in which recording of dots is not permitted. A recording permissible rate of each mask pattern 103*a* to 103*d* is evenly 25% each. The mask patterns are in complementary relationship with each other, and the recording permissible rate becomes 100% in total.

The nozzles in the nozzle array are divided into four areas in a vertical direction. The nozzles included in each area record dots according to the mask patterns 103*a* to 103*d* corresponding to each area in the mask pattern 103 and image data. In each scanning, a logical AND operation is calculated from the mask patterns 103*a* to 103*d* and the binary image data 102 after the binarization processing, and thus pixels to be actually recorded in each scanning is determined. In a logical AND operation result 104, portions each indicating a position of the pixel to be recorded in each record scanning are arranged in the vertical direction. Accordingly, it can be understood that one pixel is recorded in each of the record scanning. For example, output image data 74*b* to be recorded in the second record scanning is derived from the logical AND operation of the binary image data 102 and the mask pattern 103*b*. In other words, dots are recorded only when there is pixel data to be recorded in the binary image data, and recording of the pixel data is permitted in the mask pattern. The mask pattern including an area of 4 pixels by 8 pixels is described for simplifying the description, the mask pattern includes an area further larger in the main scanning direction and in the sub-scanning direction. Especially, it is common to conform the number of nozzles in the nozzle array of the recording head to the number of pixels of the mask pattern in the sub-scanning direction.

According to the above-described multipass recording, various recording control can be performed by imparting characteristics to the mask pattern to be prepared. Thus, according to the present exemplary embodiment, a characteristic mask pattern described below is used in the mask pattern processing in step S509 so as to differentiate recording timings of the CL1 and the CL2 from each other.

Figure 11A:
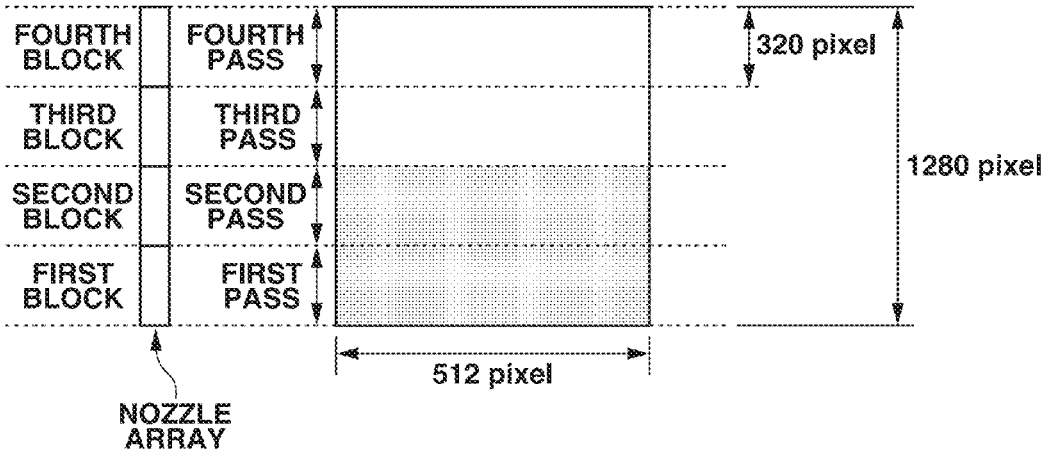
FIGS. 11A and 11B are schematic diagrams of mask patterns according to the first exemplary embodiment.
Figure 11B:
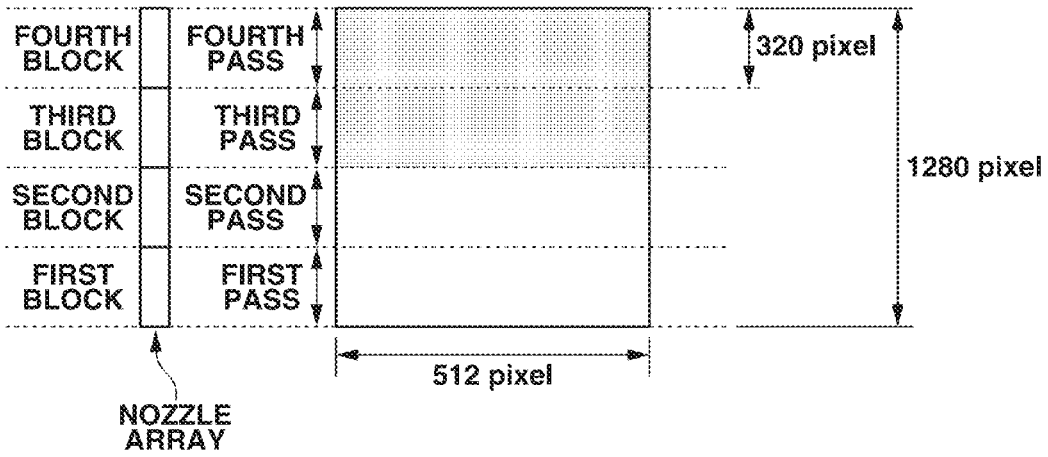

FIGS. 11A and 11B each illustrates a mask pattern used in the mask pattern processing in step S509. FIG. 11A illustrates a mask pattern for the four colored inks and the CL1 used in the mask pattern processing in step S509. A first block and a second block in the nozzle array are assigned with mask patterns which are in the complementary relationship with each other and have the recording permissible rate 50%, and the recording permissible rate of a third block and a fourth block in the nozzle array are 0%. On the other hand, FIG. 11B illustrates a mask pattern for the CL2 used in the mask pattern processing in step S509. The recording permissible rate of the first block and the second block in the nozzle array are 0%, and the third block and the fourth block in the nozzle array are assigned with mask patterns which are in the complementary relationship with each other and have the recording permissible rate 50%.

Figure 12A:
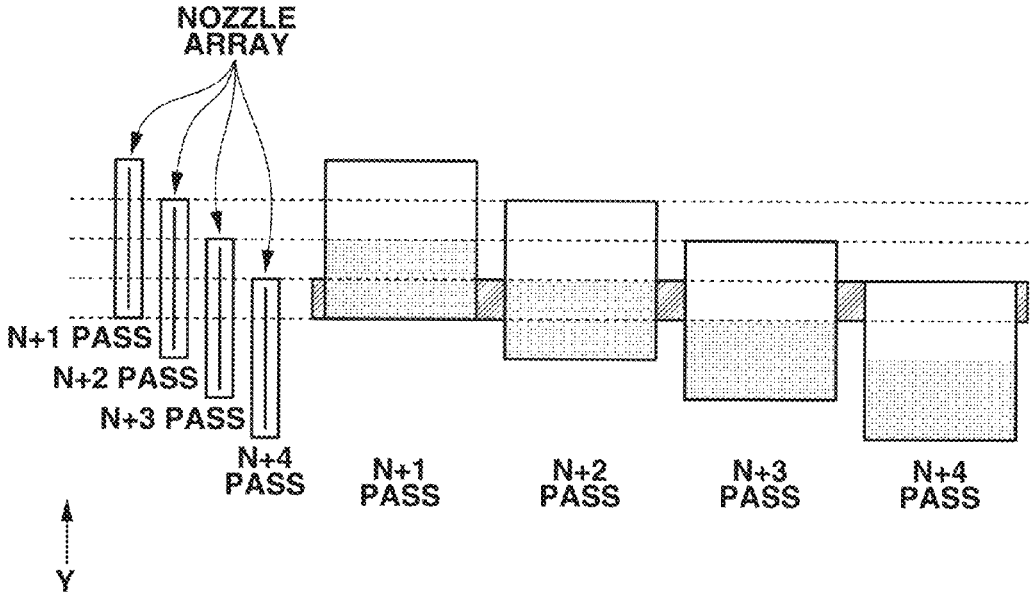
FIGS. 12A and 12B illustrate multipass recording using a mask pattern according to the first exemplary embodiment.
Figure 12B:
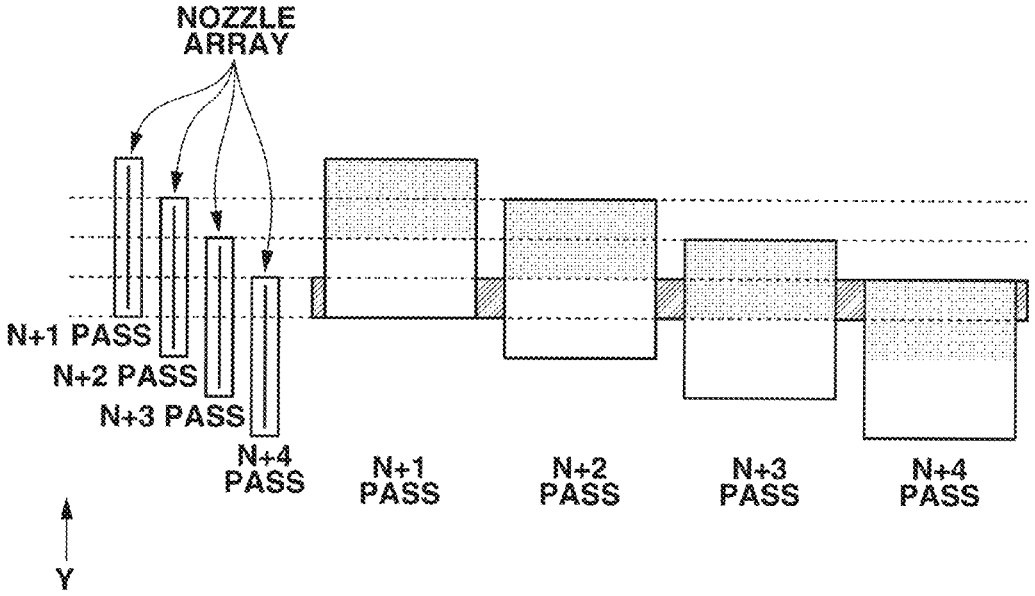

FIGS. 12A and 12B illustrate respective recording states when the multipass recording for four passes are performed using the mask patterns illustrated in FIGS. 11A and 11B. In an identical image area of the recording medium corresponding to one block of the nozzle array, recording by the mask pattern illustrated in FIG. 11A is completed in an (N+1)-th pass and an (N+2)-th pass, and then recording by the mask pattern illustrated in FIG. 11B is then performed in an (N+3)-th pass and an (N+4)-th pass. In other words, recording of the colored inks and the CL1 data of the image quality improvement liquid are completed in the (N+1)-th pass and the (N+2)-th pass, and then the CL2 data of the image quality improvement liquid is recorded in the (N+3)-th pass and the (N+4)-th pass.

As a result of the above-described image processing, a nozzle area to be actually used for recording is different for each ink in the individual nozzle array. The nozzle array discharging the colored ink uses the mask pattern in FIG. 11B, and the nozzle area actually performing a discharge operation is in a lower half thereof. On the other hand, the nozzle array for the image quality improvement liquid uses a logical sum of the both mask patterns in FIGS. 11A and 11Be and thus performs the discharge operation using all the nozzle areas. At that time, the discharge operation is performed in the lower half area based on the binary data CL1' converted from the first multi-valued data CL1, and the image quality improvement liquid is applied to the recording medium at the same timing as the colored ink. On the other hand, the discharge operation is performed in the upper half area based on the binary data CL2' converted from the second multi-valued data CL2, and the image quality improvement liquid is applied onto layers of the colored ink and the image quality improvement liquid already recorded.

Figure 13A:
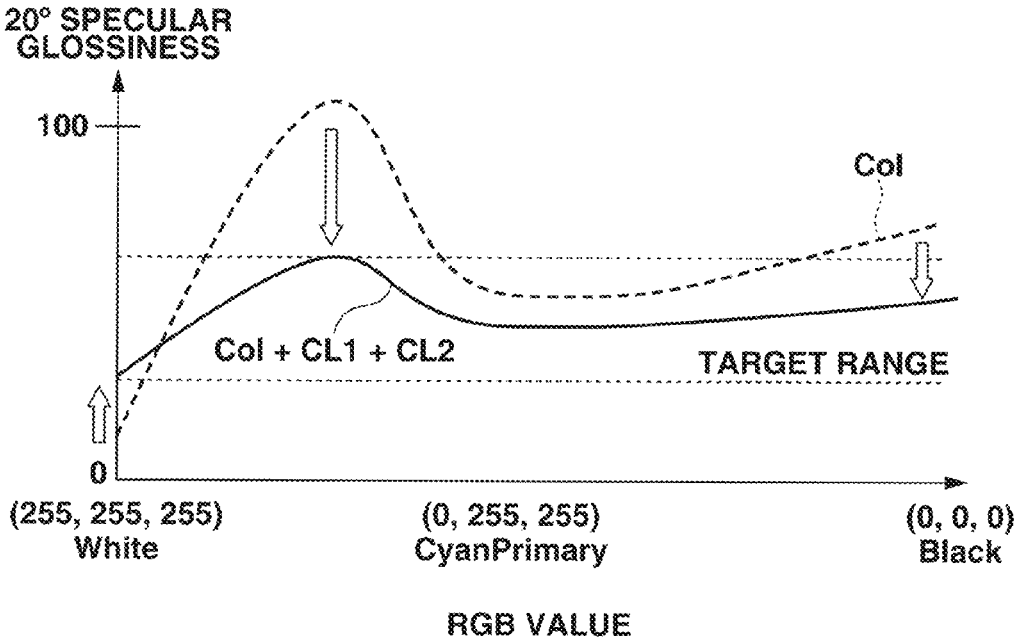
FIGS. 13A and 13B are schematic diagrams illustrating glossiness and image clarity of a recorded material according to the first exemplary embodiment.
Figure 13B:
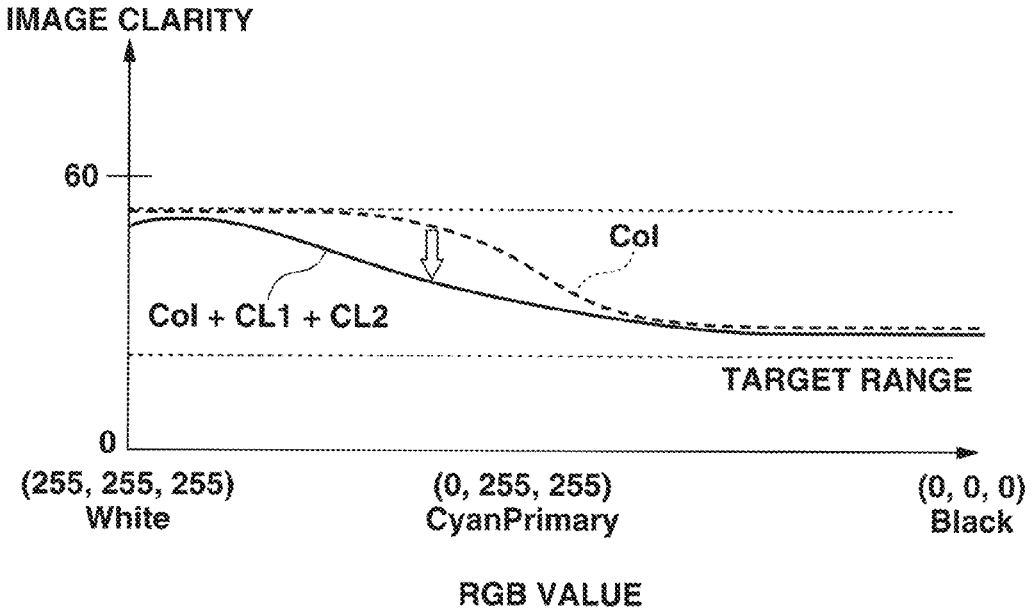

FIGS. 13A and 13B respectively illustrate the glossiness and the image clarity when the signal value conversion and the recording operation according to the present exemplary embodiment are performed. Horizontal axes in the both drawings indicate signal values of cyan lines similar to that in FIG. 9. Dashed lines indicate the glossiness and the image clarity when recording is performed without using the image quality improvement liquid, and solid lines indicate the glossiness and the image clarity when the image quality improvement liquid is recorded by the above-described method.

When only the colored inks are used, in the highlight portion from white, the image clarity is within a target range, however, the glossiness is lower than the target range. This is because that the number of dots to be recorded is few, and the gloss of the recording surface depends on the gloss of the recording medium itself as described with reference to FIG. 8A. In contrast, when the image quality improvement liquid is recorded by the method according to the present exemplary embodiment, the image quality improvement liquid is recorded in places in a blank page area as in FIG. 8D, the glossiness rises into the target range. The image clarity is also maintained in the target range.

Regarding the medium density area, when only the colored inks are recorded, the image clarity is within the target range, however, the glossiness greatly exceeds the target range. This is because that the surface of the recording medium is mostly covered with the widespread pigment inks, and the high glossiness of the pigment ink appears as described with reference to FIG. 8B. On the other hand, when the image quality improvement liquid is used by the method according to the present exemplary embodiment, an appropriate irregularity is formed as in FIG. 8E, and the glossiness falls within the target range. The image clarity is maintained within the target range despite a value thereof is decreased.

Regarding the high density area, when only the colored inks are used, the image clarity is within the target range, however, the value is considerably decreased compared to the highlight portion and the medium density area. This is because that the amount of the solid content such as the coloring material and the dispersed resin in the pigment ink become larger, and the irregularities are many formed in whole as described with reference to FIG. 8C. In addition, the glossiness exceeds the target range. In contrast, according to the present exemplary embodiment, the image quality improvement liquid is overcoated on the layer of the pigment ink as in FIG. 8F. Accordingly, the glossiness can be decreased to the target range without further decreasing the image clarity by forming the irregularity more than necessary.

FIG. 14 illustrates effects described with reference to FIGS. 13A and 13B while being associated with the recording states in FIGS. 8A to 8F. When recording is performed using only the pigment inks, as in FIGS. 8A to 8C, the glossiness varies depending on the density areas, however, when the image quality improvement liquid is additionally recorded according to the present exemplary embodiment as in FIGS. 8D to 8F, the glossiness of any density areas are coordinated to a middle range (30 to 60). On the other hand, the image clarity is maintained in the target range (the middle range). As described above, according to the present exemplary embodiment, variation of the gloss in each density area can be suppressed and the gloss unevenness can be avoided in the gloss considering both of the image clarity and the glossiness.

In the color conversion processing in step S501 according to the present exemplary embodiment, generation of the CL1 and the CL2 as described with reference to FIG. 9 can be performed in all RGB spaces without limiting to the cyan line. In other words, according to the present exemplary embodiment, an appropriate amount of the image quality improvement liquid can be applied at an appropriate timing in all gradations of all colored inks, and accordingly, the gloss of each hue can be converged on the target range in all color spaces, and the gloss can be uniformed in the entire image.

As already described above, the gloss varies depending on dot arrangement and an applying order of the colored ink and the image quality improvement liquid. However, when the application position of the image quality improvement liquid is shifted on the recording medium, a positional relationship between dots of the colored ink and the image quality improvement liquid is lost, and the gloss cannot be obtained as intended. Therefore, it can be said that adjustment of arrangement of the image quality improvement liquid is also important as with the colored ink.

A method is described below for adjusting an application position (registration adjustment) of the colored ink and the image quality improvement liquid applied to the recording medium which is characteristics of the present exemplary embodiment.

(Automatic Registration Adjustment Method)

According to the present exemplary embodiment, the following three items are adopted as adjustment items of the application position in order to adjust misalignment of the application position in the main scanning direction. Needless to say, adjustment may be performed by adopting other adjustment items according to the characteristics of the recording apparatus. For example, there is vertical direction adjustment for adjusting misalignment of each nozzle array in the vertical direction.

1. Adjustment Between Even-Odd Arrays

In FIG. 2, the Even array (the nozzle array in a dashed line frame indicated as "Even") and the Odd array (the nozzle array in a dashed line frame indicated as "Odd") which is arranged by shifting a half distance of a pitch of the nozzle array of the same CL are illustrated. The Even array and the Odd array are similarly provided in each color. In the adjustment between Even-Odd arrays, the recording position in the main scanning direction intersecting the nozzle array between the Even-Odd arrays of the same color is adjusted. A driving timing of the Odd array is adjusted based on the Even array so that a droplet discharged from the Odd array based on data for performing recording of the same column as the Even array coincides with a droplet discharged from the Even array on a recording sheet. This adjustment is performed for each color. When ink discharge speeds are different in the Even array and the Odd array, a position of the droplet on the recording sheet is affected by a distance between a discharge surface of the recording head and the recording sheet. Hereinbelow, an adjustment value indicating an adjustment amount for realizing the adjustment between Even-Odd arrays is referred to as a registration value between Even-Odd arrays.

2. Adjustment Between Forward and Return Paths

Misalignment of the recording positions between the forward direction recording and the return direction recording (see FIG. 1) in the main scanning direction of the carriage 11 is adjusted. The adjustment is performed for each color by adjusting the misalignment between the recording position in the forward direction recording of the Even array (see FIG. 2) in the main scanning direction and the recording position in the return direction recording of the Even array of the same ink color. A discharged ink droplet is ejected by receiving inertia due to a movement speed of the carriage, and thus a misalignment amount is affected by a carriage speed and an ejection time. Hereinbelow, an adjustment value indicating an adjustment amount for realizing the adjustment between forward and return paths is referred to as a registration value between forward and return paths.

3. Adjustment Between Colors

The misalignment of the recording position of another color is adjusted using one color as a reference in the main scanning direction (see FIGS. 1 and 2). According to the present exemplary embodiment, the recording position of the recording head recording the black ink is used as the reference, and the recording position of the Even array in the forward direction recording and the recording position of the Even array of an adjustment target color in the forward direction recording are adjusted. Hereinbelow, an adjustment value indicating an adjustment amount for realizing the adjustment between colors is referred to as a registration value between colors.

A detection patch 1504 (hereinbelow, simply referred to as a patch in some cases) used for the adjustment of the landing position applied to the present exemplary embodiment is described below with reference to FIGS. 15A and 15B1 to 15B4. An X direction and a Y direction in FIGS. 15A and 15B1 to 15B4 respectively correspond to the main scanning direction and the sub-scanning direction in FIGS. 1 and 2. The same can be applied to X and Y arrows shown in FIGS. 16 to 18 which are used below for describing a pattern for the registration adjustment.

The patch 1504 is a square shape patch having a uniform density. A length of the patch in the main scanning direction is at least longer than a detection spot 312 of the density sensor 311 in the optical sensor 18. A length of the patch in the sub-scanning direction is desirable to be longer than the detection spot 312 and have a margin. A shape of the patch is a square having an edge perpendicular to the scanning direction of the carriage so as to obtain a sharp rise of a signal when being detected. Since higher detection density can increase a contrast of a signal, the patch is a high density pattern having a uniform density.

As illustrated in FIG. 15A, regarding the patch 1504, the ink is discharged so that a target position 1502 in the main scanning direction by the density sensor 311 coincides of a center of the patch, however, generally the patch is formed on a position misaligned in the X direction by registration. The patch 1504 is arranged with a distance 1503 so as not to overlap with an adjacent patch 1513 if the assumed misalignment is generated. When a patch position is detected, the patch position is detected in a detection range 1501 centering on the target position 1502.

FIGS. 15B1 to 15B4 illustrate changes of a detection signal when the patch 1504 is detected by the density sensor 311 regarding the main scanning direction (the X direction). FIG. 15B1 illustrates a positional relationship between the patch 1504 and a detection spot 1505 viewed from right above, and the detection spot 1505 moves in a direction indicated by an arrow (the main scanning direction). FIG. 15B2 illustrates a positional relationship between the patch 1504 and a recording medium 1507 viewed from a side.

FIG. 15B3 illustrates changes in a detection signal 1508 based on the center of the detection spot 1505 and indicates that as the detection signal rises, the reflected light amount is larger. According to the change in the detection signal 1508, the intensity of the detection signal 1508 detected is decreased when the patch 1504 overlaps with the detection spot 1505 and stabilized at a constant level when an entire area of the detection spot 1505 overlaps with the patch 1504. At that time, the comparator 424 compares the detection signal 1508 with a threshold value 1509 and generates interrupt signals 1510 and 1511 (FIG. 15B4) at time points when the intensity of the detection signal 1508 falls below and exceeds the threshold value 1509. The threshold value 1509 is calculated in advance by measuring a patch density and performing calculation in response to the measurement result. The simplest calculation may be an average of a maximum value and a minimum value of the measurement results of the detection signal 1508.

The ASIC 412 obtains the position of the carriage by the encoder 15 at that timing according to the interrupt signals 1510 and 1511. The patch 1504 is detected while the carriage 11 is moving, two edge positions on both ends of the patch 1504 in the X direction can be detected. Resolution in detection of the position is obtained by temporally dividing signals from the encoder and multiplying by resolution, and thus is several fold of the resolution of the encoder. A center position 1512 of the detected two edge positions is determined as a position of the patch 1504 in the X direction. The position of the patch 1504 is determined from not any one of the edge positions but the center position of the two edge positions, so that an influence of position misalignment when the detection signal falls below or exceeds the threshold value can be avoided.

Figure 16:
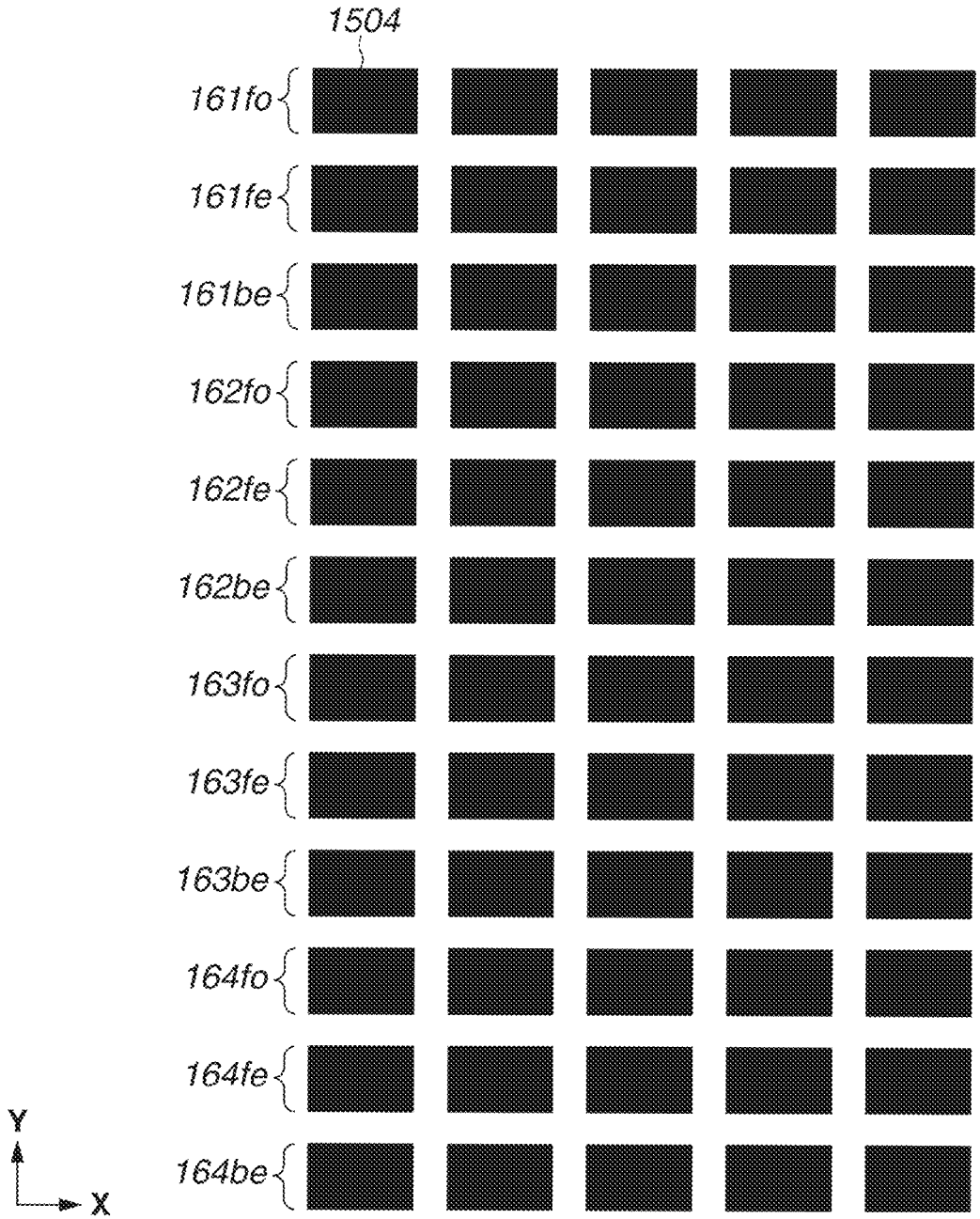
FIG. 16 is a schematic diagram of adjustment patterns according to the first exemplary embodiment.

FIG. 16 illustrates arrangement of a group of registration adjustment patterns which is formed by arranging a plurality of the patches 1504 illustrated in FIGS. 15A and 15B1 to 15B4. A pattern formation condition differs in each row. A pattern 161*fo* is recorded using the Odd array in the nozzle array for recording the K by arranging five patches in the X direction in the forward direction recording of the X direction. A pattern 161*fe* is recorded using the Even array in the nozzle array for recording the K in the forward direction recording of the X direction. A pattern 161*be* is recorded using the Even array in the nozzle array for recording the K in the return direction recording of the X direction. The ASIC 412 determines respective positions in the X direction of the pattern 161*fe* and the pattern 161*fo* based on the detection signals and detects relative position misalignment of the two patterns in the X direction. A registration value between Even-Odd arrays of the K is determined based on a position misalignment amount of the pattern 161*fo* when the pattern 161*fe* is used as a reference. Regarding the five patches arranged in the main scanning direction (the X direction), respective positions are detected, and one misalignment amount is determined by performing calculation based on the detected five misalignment amounts. According to the present exemplary embodiment, the maximum value and the minimum value of the misalignment amounts are discarded, and the misalignment amount is obtained by averaging the three remaining values. Needless to say, each pattern may include a single patch. Subsequently, the ASIC 412 detects the position misalignments of the pattern 161*fe* and the pattern 161*be* in the X direction in a similar way, determines the misalignment amount of the forward direction recording and the return direction recording of the Even array based on the landing position when the forward direction recording is performed using the Even array of the K, and determines a bidirectional registration value of the K. Similarly, patterns 162*fo*, 162*fe*, and 162*be*, patterns 163*fo*, 163*fe*, and 163*be*, and patterns 164*fo*, 164*fe*, and 164*be* are pattern groups respectively recorded using the C, M, and Y. With respect to the C, M, and Y, the registration values between Even-Odd arrays and the registration values between forward and return paths are calculated for each ink color in a similar way to the K based on detection results of the above-described adjustment patterns. Further, the position misalignment of the pattern 161*fe* and the pattern 162*fe* is detected, and the registration value between colors of the C based on the pattern 161*fe* is determined.

According to the above-described registration adjustment method, each registration value is determined which is based on dots recorded from the Even array in the reference nozzle array of the reference color K. The ASIC 412 stores each of the determined registration values in the ROM 410. In addition, when recording is performed based on image data, the recording control unit 407 performs adjustment of the recording position of the colored ink using an adjustment amount corresponding to the registration value. For example, data is not shifted in scanning in the forward path of the K, and data for recording a column corresponding to the bidirectional registration value of the K stored in the memory is shifted and transferred to the recording head in scanning in the return path. Data shift of the adjustment amount corresponding to the adjustment value is similarly performed in the above-described adjustment between colors and adjustment between Even-Odd arrays, and thus the recording position is adjusted. The same can be applied to the CL described below. Accordingly, the application positions of the colored inks and the image quality improvement liquid are correctly adjusted.

When the density sensor 311 is used, an appropriate light source of which a reflected light amount is large is selected from the LED light sources of RGB for each ink, and detection is performed. For example, when a position of a patch of the C ink is detected, the incident light from the G-LED and the B-LED are easily absorbed and reflected light amounts thereof are small, so that the R-LED is generally used.

The registration adjustment method of the colored ink using the density sensor 311 is described above. The reference color is not necessarily the K, and may be another color, such as the C or the M.

However, in the above-described method, a pattern position is detected using the density sensor 311, so that it is difficult to detect a pattern position of the image quality improvement liquid which is transparent or white.

According to the present exemplary embodiment, automatic registration adjustment of an ink which is transparent or white and difficult for the density sensor 311 to detect is performed by the specular reflection sensor 310. A registration adjustment method using the specular reflection sensor 310 is described below.

The specular reflection sensor 310 detects a light amount of the reflected light of which an incident angle and a reflection angle are the same and to which magnitudes of the smoothness and the refractive index due to the irregularity of the surface are reflected as a read value. The light corresponds to the glossiness, and the position detection using the specular reflection sensor 310 is to realize the position detection by detecting a difference in the glossiness of the detection surface unlike the density sensor 311 which performs the position detection by detecting a change in the density of the scattering light. Hereinbelow, an example is described in which a glossy medium such as glossy paper is used as a recording medium 1701.

FIGS. 17A1 to 17A3 illustrate a detection signal 1703 (a vertical axis indicates intensity of the signal) when a position of a CL patch 1702 formed on a surface of the recording medium 1701 is detected in the main scanning direction (FIG. 17A1) using the specular reflection sensor 310. FIG. 17A2 is a cross-sectional view of a patch forming portion corresponding to FIG. 17A1, and a signal intensity in FIG. 17A3 is a signal intensity of each position on a horizontal axis intersecting the vertical axis, and each position on the horizontal axis corresponds to each position in FIG. 17A2. A correspondence relationship among FIGS. 17A1 to 17A3 is similar to each drawings in FIGS. 17B1 to 17B3, 17C1 to 17C3, and 17D1 to 17D3. Arrows illustrated in FIGS. 17B1, 17C1, and 17D1 indicate scanning directions of the specular reflection sensor 310 which are also similar to that in FIG. 17A1.

Similar to the detection signal of the density sensor 311, a higher detection signal indicates that a detection amount is larger, and as the detection signal is larger, the glossiness of the detection surface is higher. When the CL is directly applied on the recording medium 1701 to form the patch 1702, the patch 1702 can slightly sink in the recording medium 1701 depending on a type of the recording medium (FIG. 17A3). In such a case, it can be assumed that the glossiness of the surface of the recording medium 1701 is not largely changed, so that it is desirable to prepare a sensor having sensitivity which can sufficiently detect a difference in consideration of a difference of the glossiness of the patch 1702 and a peripheral area (here, the surface of the recording medium 1701) thereof.

FIG. 17B3 illustrates a detection result when a ground 1704 is formed by the black ink on the surface of the recording medium 1701, and then the CL patch 1702 is formed thereon as illustrated in a top view in FIG. 17B1 and in a cross-sectional view in FIG. 17B2. The detection direction is the same as that in FIGS. 17A1 to 17A3. A detection signal 1705 (the vertical axis indicates intensity of the signal) is broadly divided into three stages, namely the reflected light from the recording medium 1701, the reflected light from only the ground 1704, and the reflected light from the CL patch 1702 on the ground 1704. In these stages, a measurement result of the recording medium 1701 is discarded, and two values namely the reflected light from only the ground 1704 and the reflected light from the CL patch 1702 on the ground 1704 are used. As indicated by the detection signal 1705, when the CL patch is formed by recording the CL pattern on the black ink ground, a decrease amount of the glossiness in an area in which the CL patch is formed is large compared to a case when recording is performed directly on the recording medium 1701. It can be thought that the black ink layer including the coloring material is formed below the CL, and accordingly the resin component included in the CL remains on a surface of the black ink and produces an effect of decreasing the glossiness. Thus, a difference of the maximum value and the minimum value of the detection signal 1705 is large between an area in which the ground 1704 is formed on the recording medium 1701 and an area in which the patch 1702 is formed by pattern recording by the CL ink further on the ground 1704, and calculation of the threshold value is easy. Calculation of a threshold value 1706 used for the position detection is performed in response to the measurement result similarly to the detection of the colored ink. Points where continuously change are regarded as a shifting area between patterns and discarded, and the threshold value 1706 is obtained from an average of the maximum value and the minimum value of the measurement results.

When the black ink is applied below the CL as described above, the position detection of the CL can be performed with the high detection sensitivity by the specular reflection sensor 310 detecting the glossiness of the surface of the patch and the surface of the peripheral area of the patch. Accordingly, if an element included in the detection sensor is not so high sensitive, registration adjustment can be accurately performed. The ASIC 412 performs the position detection as described above and realizes obtainment of the registration value between Even-Odd arrays and the registration value between forward and return paths of the CL in response to the detected position.

In order to determine the registration value between colors of the CL, it is necessary to detect the relative misalignment amount between the reference color as the colored ink and the CL. As described above, position information of the reference color as the colored ink is obtained by the density sensor 311. On the other hand, the position information of the CL is difficult for the density sensor 311 to detect as described above, so that the value detected by the specular reflection sensor 310 is used as the position information of the CL. However, as illustrated in FIGS. 3A and 3B, the spot positions of the density sensor 311 and the specular reflection sensor 310 are different. In order to accurately determine the relative misalignment amount between the reference color and the CL, the misalignment between the spot positions of the density sensor 311 and the specular reflection sensor 310, in other words the misalignment of optical axes is required to be adjusted. However, even if the misalignment of the optical axes is adjusted in some way, an error is smaller when the respective position information pieces obtained by the same sensor (=there is no misalignment of the optical axes) are used.

According to the present exemplary embodiment, the registration value between colors of the CL and the reference color is determined without being affected by the misalignment of the optical axes of the specular reflection sensor 310 and the density sensor 311. In order to determine the registration value between colors of the CL by removing the influence of the misalignment of the optical axes, the position of the reference color is necessary to be calculated using the specular reflection sensor 310, so that a method described below is used. A method for performing position detection of both of the reference color and the CL by the specular reflection sensor 310 is described below.

FIGS. 17C1 to 17C3 illustrate a detection result when a patch 1710 of the reference color K (black) is formed on the surface of the recording medium 1701 and detected by the specular reflection sensor 310 as illustrated in a top view in FIG. 17C1 and in a cross-sectional view in FIG. 17C2. The detection direction is the same as that in FIGS. 17A1 to 17A3. A detection signal 1707 (the vertical axis indicates intensity of the signal) is broadly divided into two stages, namely the reflected light from the recording medium 1701 and the reflected light from only the patch 1710. The color ink including the coloring material does not sink in the recording medium as in the case of the CL, however, there is not so much difference between the maximum value and the minimum value of the detection signal 1707 enough to detect a position of the K patch. The smaller the difference of the glossiness between the surface of the K patch and the recording medium 1701 is, the more detection is difficult. In other words, when a difference of gloss is small between the registration adjustment pattern formed by recording the reference color and the recording medium, it is difficult to perform the position detection of the reference color using the specular reflection sensor 310, and the registration value between colors of the CL cannot be accurately determined.

FIGS. 17D1 to 17D3 illustrate a method for realizing the position detection of a patch 1711 of the colored ink K with high accuracy using the above-described specular reflection sensor 310. As illustrated in FIG. 17D2, an overcoating material 1712 of the CL is arranged so as to cover a surface of the K patch 1711, and a pattern is formed. As indicated by a detection signal 1708 (the vertical axis indicates intensity of the signal) obtained by measuring the glossiness of respective surface of the patch 1711 and its peripheral area, the glossiness is largely different between a portion where the overcoating material 1712 is formed on the K patch 1711 and a portion where the overcoating material 1712 is directly formed on the recording medium 1701. Similar to the above-described example, the ASIC 412 can detect both edge positions of the K patch 1711 in the X direction and detect a position of the patch 1711. When the K patch 1711 is covered by the CL as described above, a patch forming position can be detected.

The glossiness of an area where the overcoating material 1712 is disposed over the K patch 1711 is small compared to two areas of an area where the CL patch 1702 is recorded directly on the recording medium and an area where only the K patch 1710 is recorded. It is considered that because a filling layer is formed on a surface portion of the recording medium by the coloring material and the resin included in the K patch 1711, and the resin component included in the CL forms the irregularity and remains on the filling layer. As the refractive index of the material used as the resin component of the CL is lower, the glossiness of a surface of a forming area is decreased due to forming of the overcoating material 1712. Regarding a positional relationship between the K patch 1711 and the overcoating material 1712, when the position detection is performed in a predetermined direction, it is desirable that the overcoating material 1712 is disposed on the edge position of the K patch 1711 and its peripheral surface in the predetermined direction. In the example in FIGS. 17D1 to 17D3, the position in the X direction is to be detected, and the overcoating material 1712 is disposed on the both edge portions from one edge to the other edge in the X direction. In order to detect the both edge portions of the patch 1711 in a similar way to the above description, it is necessary to differentiate (to decrease in this case) the glossiness of the both edge portions of the K patch 1711 from that of an adjacent area in the X direction, so that the overcoating material 1712 is formed on the edge portions in the X direction. Further, it is only necessary to detect the both edge portions of the patch 1711, and thus the overcoating material 1712 is not required to be disposed on a center portion. In such a case, the glossiness of an area corresponding to the center portion becomes higher, however, such detection signal may be ignored. Furthermore, when the position of the K patch 1711 on the recording medium 1701 is determined by detecting one edge of the K patch 1711, the overcoating material 1712 may be disposed on only the one edge portion of the K patch 1711 in the X direction.

In the example illustrated in FIGS. 17D1 and 17D2, the overcoating material 1712 is disposed not only on the K patch 1711 but also on the peripheral surface of the recording medium 1701. In the above-described example, the glossiness of the recording medium 1701 is sufficiently high compared to the overcoating material 1712 on the K patch 1711, and the overcoating material 1712 is disposed to coincide with the K patch 1711, so that the position of the K patch 1711 can be detected if the overcoating material 1712 is not disposed on right above the recording medium 1701. However, in a stage before forming a patch, the registration value between the nozzle array of the CL and the nozzle array of the K is not determined, so that control cannot be performed to match the positions of the K patch 1711 and the overcoating material 1712 with each other. Therefore, if there is some position misalignment between the CL and the K, the CL is applied in a range with an enough margin so that the overcoating material 1712 is disposed on the K patch 1711 and its peripheral by exceeding the K patch 1711.

In this regard, an imparting material to be overcoated for forming the irregularity on the surface of the K patch 1711 may not necessarily be the CL. The detection target is consistently the K patch, and the above-described overcoating material using the CL is an example of an auxiliary material for changing the glossiness of the surface of the K patch in order to detect the K patch. If an ink or an imparting material capable of developing such function can be applied by the recording apparatus, the above-described overcoating material may be formed using the ink or the imparting material. For example, if the recording head can discharge gray (GY) or light gray (LGY) which has a same hue and higher brightness than GY as an achromatic color ink, the overcoating material 1712 can be formed using the GY or the LGY. For example, when resin densities of these inks are higher than those of the C, M, and Y inks, and an effect similar to that of the above-described CL can be expected in the detection by the specular reflection sensor 310, it is desirable to use these inks. Further, for example, when the overcoating material 1712 is formed using the colored ink GY, a registration value between colors of the K and the GY is determined in advance by the density sensor 311, and the determined registration value can be used in the position detection of the K patch 1711. More specifically, the overcoating material 1712 is formed so as to fit to a center of the K patch 1711 in the X direction using the registration value between colors of the K and the GY. At that time, the edge portion does not need to be overcoated. Subsequently, when the specular reflection sensor 310 detects a portion of which the glossiness is significantly low compared to the peripheral area, the relevant area is a portion of the overcoating material of the GY and determined as the center of the K patch 1711. Since the relative position of the K and the GY can be controlled by the registration value, and the above-described operation can be performed. Further, when the nozzle array of the GY is formed on the same chip as the nozzle array of the K, it can be regarded that the registration misalignment between colors is small between the K and the GY, and detection may be performed by disposing the overcoating material of the GY on a predetermined portion of the K patch 1711 using a predetermined registration value without performing the registration adjustment between colors.

Figure 18:
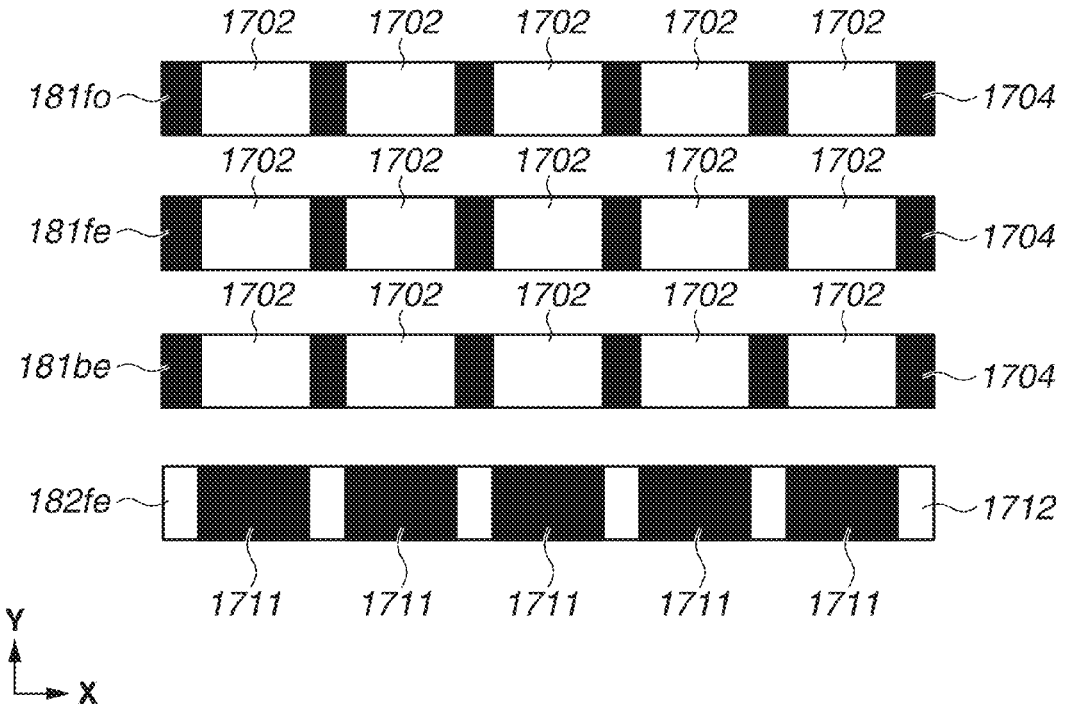
FIG. 18 is a schematic diagram of adjustment patterns according to the first exemplary embodiment.

FIG. 18 illustrates arrangement of patterns for the registration adjustment which is formed by arranging a plurality of the K patches and the CL patches illustrated in FIGS. 17B1 and 17D1. In order to more certainly perform the position detection of the K patch and the CL patch using the specular reflection sensor 310, patterns 181*fo*, 181*fe*, and 181*be* are formed by forming a ground using the colored ink K in advance and applying the CL thereon. The pattern 181*fo* is a pattern of the patches 1702 formed using the Odd array of the CL in the forward path scanning by the carriage in the X direction. The pattern 181*fe* is a pattern of the patches 1702 formed using the Even array of the CL in the forward path scanning by the carriage in the X direction. The pattern 181*be* is a pattern of the patches 1702 formed using the Even array of the CL in the forward path scanning by the carriage in the X direction. A pattern 182*fe* is formed by forming the five patches 1711 by the Even array of the K and mutually disposing the overcoating material 1712 on the five patches 1711.

The registration value between colors between the Even array of the K and the Even array of the CL can be obtained from each positional relationship of the pattern 182*fe* and the pattern 181*fe*. Further, the registration value between forward and return paths of the CL can be obtained from each positional relationship of the pattern 181*fe* and the pattern 181*be*. Furthermore, the registration value between Even-Odd arrays of the CL can be obtained from each positional relationship of the pattern 181*fe* and the pattern 181*fo*.

The above-described patterns of the ground of the K are high density uniform patterns, however, each pattern of the CL patch is, for example, a halftone uniform pattern. Regarding selection of the halftone, if the density is set to the one in which specular reflection is most changed when the CL patch is detected on the ground formed by the K, the detection accuracy can be further improved. According to the present exemplary embodiment, the recording density is 30%. This is a state in which dots are disposed on 30% of positions at which image can be formed. The pattern 182*fe* is a pattern to be formed for detecting the position of the K by the specular reflection sensor 310. According to the present exemplary embodiment, the registration value between Even-Odd arrays and the registration value between forward and return paths of the colored ink K are determined from detection results by the density sensor 311. The detection by the specular reflection sensor 310 is required by only the pattern 182*fe* used as the reference color of the registration value between colors.

In the patterns 181*fo*, 181*fe*, and 181*be*, it is desirable that the ground 1704 of the K recorded below the CL can firmly remain the CL on the K and be formed in a high dot density. Recording of a pattern for the registration adjustment of the CL is performed using any of the Even array or the Odd array. Therefore, it is desirable that the ground 1704 is formed by arranging K dots in a density higher than a dot density in the Y direction corresponding to a nozzle pitch interval of only the Even array or only the Odd array. Thus, when the ground 1704 is formed by recording the pattern of the K in single scanning by the carriage 11, it is desirable that the recording is performed using both of the Even array and the Odd array of the K. Accordingly, for example, if the patches 1702 are formed in the pattern 181*fe* by the single scanning of the carriage using only the Even array of the CL, a dot of the Even array of the K is arranged immediately below each CL dot. If registration in the Y direction (vertical registration) is shifted about a half of a nozzle pitch of the Even array between the K and the CL, in such a case, dots formed by the Odd array of the K support dots of the CL.

Next, processing of the registration adjustment between colors of the CL and the reference color which is the characteristic configuration of the present invention is described with reference to a flowchart illustrated in FIG. 19. First, in step S1901, the recording control unit 407 enters a mode for executing the automatic registration adjustment. The recording control unit 407 shifts to the mode by a user inputting an instruction from the image input unit 402 to the image output unit 404 as the recording apparatus or, in the case where the image output unit 404 is provided with a use interface (UI), the mode is shifted by an input via the UI. In addition, shift of the mode may be automatically executed at a predetermined time interval by the image output unit 404 as a regular maintenance of the apparatus.

In step S1902, the recording control unit 407 control a medium conveyance system to feed the recording medium set by a user to the recording position of the recording head.

Next, in step S1903, the recording control unit 407 causes the recording head to record, for example, the adjustment patterns of the colored inks (here K, C, M, and Y) as described with reference to FIG. 16.

In step S1904, the density sensor 311 of the optical sensor 18 measures the registration adjustment pattern recorded in step S1903 based on the instruction from the recording control unit 407, and the ASIC 412 performs the position detection of a patch in each pattern.

Next, in step S1905, the ASIC 412 determines the registration value corresponding to the nozzle array of each color based on the detection result in step S1904 and once stores the registration value in the RAM 411. When there is the nozzle array of which the adjustment value is not determined yet by the adjustment using the density sensor (NO in step S1905), the processing returns to step S1903, and otherwise (YES in step S1905) the processing proceeds to step S1906.

Next, in step S1906, the recording control unit 407 causes the recording head to record the pattern for performing the position detection of the K patch by the specular reflection sensor 310 as described with reference to FIGS. 17A1 to 17D3 and 18.

Further, in step S1907, the recording control unit 407 records the pattern for performing the position detection of the CL patch by the specular reflection sensor as described with reference to FIGS. 17A1 to 17D3 and 18.

Then, in step S1908, the specular reflection sensor 310 measures the positions of the patterns of the K and the CL recorded in steps S1906 and S1907 based on the instruction from the recording control unit 407, and the ASIC 412 performs the position detection of each patch.

In step S1909, the ASIC 412 determines the registration value between colors of the Even array of the CL based on the Even array of the K, the registration value between forward and return paths of the CL, and the registration value between Even-Odd arrays of the CL based on the detection results in step S1908 and once stores these registration values in the RAM 411.

Then, in step S1910, the registration values (the colored ink and the CL) in the RAM 411 are together stored in the ROM 410.

The registration adjustment processing is completed as described below.

Figure 19:
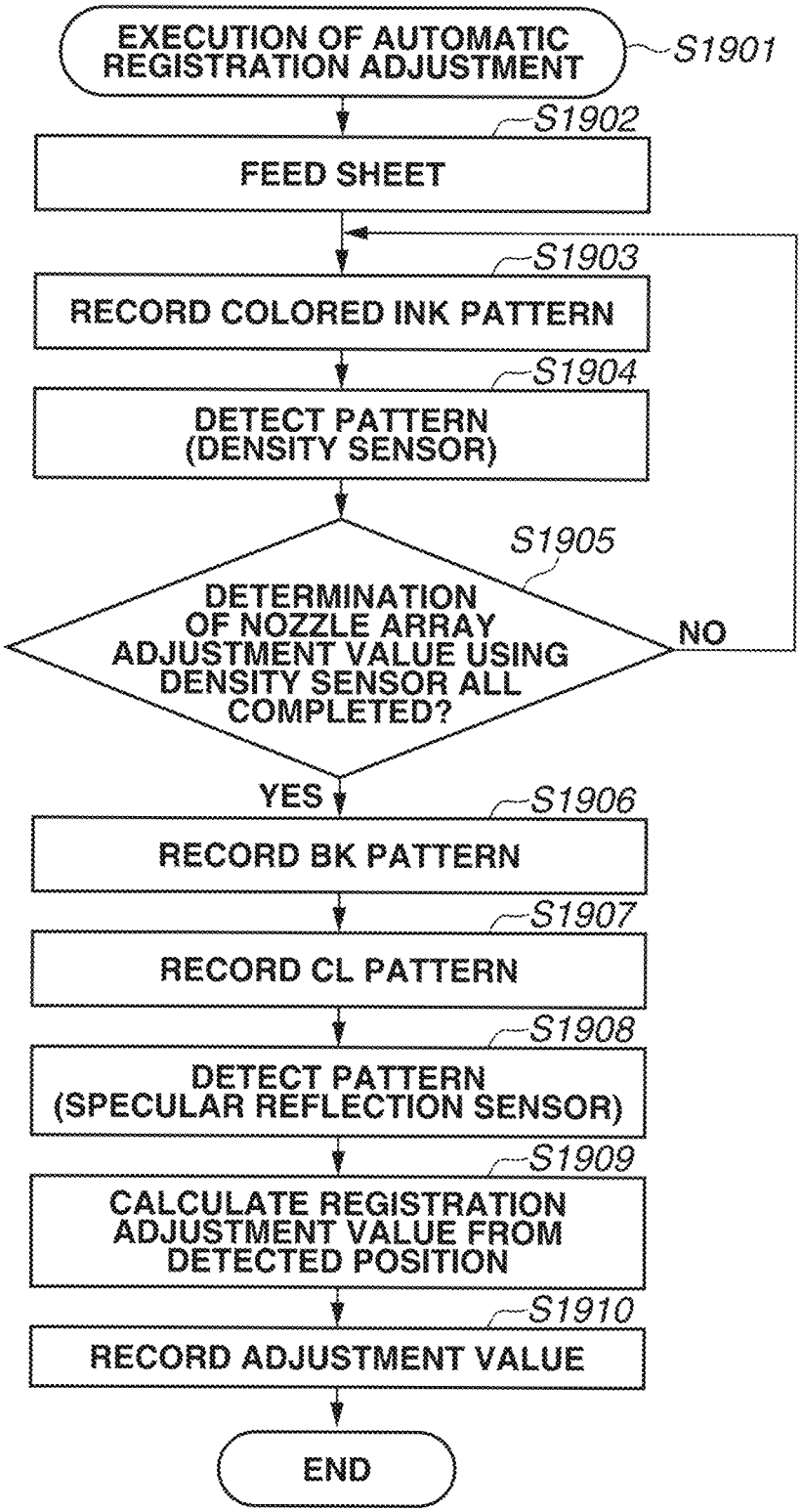
FIG. 19 is a flowchart illustrating a flow of processing for adjusting a recording position according to the first exemplary embodiment.

In FIG. 19, the detection is performed by the specular reflection sensor 310 after the detection using the density sensor 311 is completed, however, formation of the pattern is not necessarily performed in a separating manner. All patterns to be read by the density sensor 311 and the specular reflection sensor 310 may be completely formed, and then the pattern may be detected by the density sensor 311 and the specular reflection sensor 310. Alternatively, patterns to be detected by the specular reflection sensor 310 may be recorded first, and then patterns to be detected by the density sensor may be formed.

According to the above-described first exemplary embodiment, the adjustment pattern is recorded without changing a speed in the main scanning direction (hereinbelow, referred to as a CR speed) and a distance from a discharge port to the recording medium (hereinbelow, referred to as a distance between head and sheet), and the automatic registration adjustment is performed. It is known that the registration adjustment value determined based on the adjustment pattern recorded at an arbitrary CR speed and an arbitrary distance between head and sheet can perform the position adjustment most accurately at the above-described arbitrary conditions. However, an appropriate registration value varies according to the speed in the main scanning direction (hereinbelow, referred to as the CR speed) and the distance from the discharge port to a landing surface (hereinbelow, referred to as the distance between head and sheet). In reality, the recording apparatus generally performs control to switch the CR speed. In addition, the distance between head and sheet varies according to a thickness of the recording medium and a height of the recording head.

A second exemplary embodiment is directed to determination of an appropriate registration adjustment value for a plurality of CR speeds and a plurality of head heights under respective conditions.

FIG. 20 illustrates adjustment patterns to be detected by the specular reflection sensor 310 for determining the registration adjustment value corresponding to two CR speeds and two distances between head and sheet. FIG. 20 includes four areas 201 to 204. Each area is used for the detection by the specular reflection sensor 310 for determining the registration value between Even-Odd arrays (a first line), the registration value between forward and return paths (a second line), and the registration value between colors (a third line) of the CL similar to the patterns illustrated in FIG. 18. A fourth line is a pattern for the position detection of the reference color K. Patterns are recorded in the areas 201 to 204 using combinations of the CR speed and the distance between head and sheet which differ from each other. The adjustment patterns illustrated in FIG. 20 are detected by the density sensor 311 and the specular reflection sensor 310, and thus appropriate registration adjustment values corresponding to a plurality of CR speeds and a plurality of distances between head and sheet can be obtained.

Other Embodiments

The optical sensor 18 used in the above-described exemplary embodiments includes one light-receiving unit and two light-emitting unit to realize the function of the density sensor and the specular reflection sensor, however, the optical sensor 18 is not limited to the above-described method. For example, two light-receiving units and one light source can similarly realize the two types of functions, and the density sensor and the specular reflection sensor may be separately mounted on the recording apparatus.

Further, according to the above-described exemplary embodiments, it is described that the adjustment pattern to be detected by the specular reflection sensor is constituted of the colored ink and the image quality improvement liquid which overlap with each other, and lengths thereof are the same in the Y direction, however, the length in the Y direction may differ from each other. For example, in the patterns 181*fo*, 181*fe*, and 181*be* in FIG. 18, a length of the ground 1704 of the K in the Y direction may be set longer than a length of the CL patch 1702, and in the pattern 182*fe*, a length of the CL overcoating material 1712 in the Y direction may be set longer than a length of the K patch 1711. When a size of a pattern is contrived, the imparting material for the position detection can be more certainly overlap with another ground or the overcoating material.

Further, according to the above-described exemplary embodiments, the example of the multipass recording which records an image by conveying the recording medium in a plurality of times of scanning is described, however, the present invention can be applied to recording referred to as full line recording which records an image by a single scanning using the recording head including a plurality of the nozzle arrays. Furthermore, according to the above-described exemplary embodiments, the example for using the recording head including one line of the nozzle array for one color ink is described, however, the recording head including a plurality of the nozzle arrays for one color may be used. Relative scanning for a plurality of times is not necessarily limited to a configuration in which the recording head or the recording medium are scanned for a plurality of times. For example, when the recording head provided with a plurality of nozzle arrays records an image by single scanning of the recording medium, relative scanning of one nozzle array and the recording medium may be regarded as one time, and single scanning by the recording head provided with a plurality of nozzle arrays may be regarded as a plurality of times of relative scanning.

In addition, the present invention can be applied to all recording apparatuses using a recording medium such as paper, cloth, unwoven cloth, and an overhead projector (OHP) film, and as specific apparatuses applying the present invention, office machines such as printers, copying machines, and facsimile and other mass production machines can be cited.

Further, according to the above-described exemplary embodiments, it is described that the recording control unit 407 which performs the processing characteristic of the present invention is included within the ink jet recording apparatus, however, the recording control unit 407 does not need to be included within the ink jet recording apparatus. For example, a print driver of a host computer (the image input unit 402) connected to the ink jet recording apparatus may have a function of the above-described recording control unit 407. In this case, the print driver generates binary image data based on multi-valued input image data received from an application and supplies the binary image data to the recording apparatus. As described above, an ink jet recording system constituted of the host computer and the ink jet recording apparatus is included within the scope of the present invention. In this case, the host computer functions as a data supply apparatus for supplying data to the ink jet recording apparatus and also functions as a control apparatus for controlling the ink jet recording apparatus.

Further, data processing performed by the recording control unit 407 is one of features of the present invention. Therefore, a data generation apparatus provided with the recording control unit 407 which performed the processing characteristic of the present invention is also included within the scope of the present invention. When the recording control unit 407 is included in the ink jet recording apparatus, the ink jet recording apparatus functions as the data generation apparatus of the present invention, and when the recording control unit 407 is included in the host computer, the host computer functions as the data generation apparatus of the present invention.

Further, a computer program for causing a computer to execute the above-described characteristic data processing and a storage medium storing the program so as to be readable by a computer are also included within the scope of the present invention.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the above-described exemplary embodiments, when patterns of a colored ink and another imparting material are respectively detected, reduction of detection sensitivity of respective detected patterns can be suppressed while suppressing a detection error, and relative application positions on a recording medium between both imparting materials can be accurately adjusted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110375, filed May 29, 2015, which is hereby incorporated by reference herein in its entirety.

What is claimed is:

1. A recording apparatus comprising:

a recording unit, configured to perform recording on a recording medium using a pigment ink including a pigment coloring material and a transparent liquid including resin and substantially not including a coloring material, and provided with a first nozzle for discharging the pigment ink and a second nozzle for discharging the transparent liquid;

a control unit configured to cause the recording unit to form a first detection patch and a second detection patch on the recording medium which are used for adjustment of a relative recording position between the first nozzle and the second nozzle on the recording medium;

a detection unit configured to detect information indicating a relative position between the first detection patch and the second detection patch in a predetermined direction based on a measurement result of reflected light when areas respectively including the first and the second detection patches formed on the recording medium by the recording unit are irradiated with light; and a determination unit configured to determine a relative adjustment amount of an application position between the first nozzle and the second nozzle in the predetermined direction based on a detection result by the detection unit, wherein the control unit causes the recording unit to form the first detection patch by the pigment ink using the first nozzle on the recording medium and to dispose a coating material including resin on an edge portion of the first detection patch, and to form a ground by a pigment ink on the recording medium and to form the second detection patch by applying the transparent liquid on the formed ground by the second nozzle, and the detection unit detects the information by measuring specular reflected light from an area including the first detection patch on which the coating material is disposed irradiated with light and measuring specular reflected light from an area including the second detection patch irradiated with light.

2. The recording apparatus according to claim 1, wherein the recording unit performs recording by discharging the pigment ink and the transparent liquid while causing the recording medium, the first nozzle and the second nozzle aligned in the predetermined direction to perform relative scanning.

3. The recording apparatus according to claim 1, wherein the recording unit performs recording by discharging the pigment ink and the transparent liquid while causing the first nozzle and the second nozzle to perform scanning with respect to the recording medium.

4. The recording apparatus according to claim 1, wherein a remaining tendency of the coating material applied on the first detection patch to remain on the first detection patch is larger than a remaining tendency of the coating material applied to the recording medium to remain on a surface of the recording medium.

5. The recording apparatus according to claim 1, wherein the coating material is formed by the transparent liquid.

6. The recording apparatus according to claim 1, wherein the control unit causes the recording unit to apply the coating material on an edge portion of the first detection patch so as to increase a difference between smoothness of a surface an edge portion of the patch in the predetermined direction and smoothness of a peripheral area of the patch on the recording medium, and the detection unit detects information regarding a position of the edge portion of the first detection patch based on a measurement result of the first detection patch.

7. The recording apparatus according to claim 1, wherein the pigment ink is black pigment ink.

8. The recording apparatus according to claim 1, wherein the control unit causes the recording unit to form the first detection patch and the ground by the same pigment ink.

9. A method comprising:

forming a first detection patch and a second detection patch on a recording medium, using a recording unit configured to perform recording on the recording medium using a pigment ink including a pigment coloring material and a transparent liquid including resin and substantially not including a coloring material and provided with a first nozzle for discharging the pigment ink and a second nozzle for discharging the first transparent liquid, the first detection patch and the second detection patch being used for adjustment of a relative recording position between the first nozzle and the second nozzle on the recording medium;

detecting information indicating a relative position between the first detection patch and the second detection patch in a predetermined direction based on a measurement result of reflected light when areas respectively including the first and the second detection patches formed on the recording medium in the forming are irradiated with light; and determining a relative adjustment amount of an application position between the first nozzle and the second nozzle in the predetermined direction based on a detection result in the detecting, wherein, the forming includes, forming the first detection patch by the pigment ink on the recording medium using the first nozzle and disposing a coating material including resin on an edge portion of the first detection patch, and forming a ground by a pigment ink on the recording medium and forming the second detection patch by applying the transparent liquid on the formed ground by the second nozzle, and in the detecting, the information is detected by measuring specular reflected light from an area, including the first detection patch on which the coating material is disposed, irradiated with light and measuring specular reflected light from an area, including the second detection patch, irradiated with light.

10. The method according to claim 9, wherein the pigment ink and the transparent liquid are discharged the recording medium, the first nozzle and the second nozzle aligned in the predetermined direction to perform relative scanning.

11. The method according to claim 9, wherein the pigment ink and the transparent liquid are discharged while the first nozzle and the second nozzle move with respect to the recording medium.

12. The method according to claim 9, wherein a remaining tendency of the coating material applied on the first detection patch to remain on the first detection patch is larger than a remaining tendency of the coating material applied to the recording medium to remain on a surface of the recording medium.

13. The method according to claim 9, wherein the coating material is formed by the transparent liquid.

14. The method according to claim 9, wherein the pigment ink is black pigment ink.

15. The method according to claim 9, wherein the first detection patch and the ground are formed by the same pigment ink.

* * * * *